US009493010B2

(12) United States Patent
Kudo et al.

(10) Patent No.: US 9,493,010 B2
(45) Date of Patent: Nov. 15, 2016

(54) LIQUID CONTAINER

(71) Applicant: SEIKO EPSON CORPORATION, Tokyo (JP)

(72) Inventors: Shoma Kudo, Nagano (JP); Naomi Kimura, Nagano (JP);
(Continued)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/770,332

(22) PCT Filed: Feb. 26, 2014

(86) PCT No.: PCT/JP2014/001014
§ 371 (c)(1),
(2) Date: Aug. 25, 2015

(87) PCT Pub. No.: WO2014/132634
PCT Pub. Date: Sep. 4, 2014

(65) Prior Publication Data

US 2016/0009100 A1 Jan. 14, 2016

(30) Foreign Application Priority Data

Mar. 1, 2013 (JP) ..... 2013-040405
Sep. 26, 2013 (JP) ..... 2013-199382

(51) Int. Cl.
*B41J 2/175* (2006.01)

(52) U.S. Cl.
CPC ..... *B41J 2/17553* (2013.01); *B41J 2/17513* (2013.01)

(58) Field of Classification Search
CPC ..... B41J 2/175; B41J 2/17503; B41J 2/17513
(Continued)

(56) References Cited

U.S. PATENT DOCUMENTS 4,931,814 A 6/1990 Yoshimura
5,721,576 A 2/1998 Barinaga
(Continued)

FOREIGN PATENT DOCUMENTS

CN 2367456 Y 3/2000
JP 2012-020495 A 2/2012
(Continued)

*Primary Examiner* — Julian Huffman
*Assistant Examiner* — Sharon A Polk
(74) *Attorney, Agent, or Firm* — Global IP Counselors, LLP

(57) ABSTRACT

A liquid container includes a container portion configured to contain ink; an air chamber configured to contain the air that is introduced into the container portion; a first air introducing path configured to introduce the outside air into the air chamber; and a second air introducing path configured to introduce the air contained in the air chamber into the container portion. The first introducing port is located vertically above a liquid level in the air chamber of the ink flowing from the container portion into the air chamber, in a first attitude that the container portion and the air chamber are aligned in a direction intersecting with a vertical direction and that a first introducing port of the first air introducing path is located vertically above a delivery port of the second air introducing path.

13 Claims, 24 Drawing Sheets

(72) Inventors: Hidenao Suzuki, Nagano (JP);
Munehide Kanaya, Nagano (JP);
Yasunori Koike, Nagano (JP);
Tokujiro Okuno, Fukuoka (JP)

(58) Field of Classification Search
USPC ..... 347/84–86
See application file for complete search history.

(56) References Cited

U.S. PATENT DOCUMENTS

| | | | |
|---|---|---|---|
| 5,841,453 | A | 11/1998 | Sasaki |
| 6,053,604 | A | 4/2000 | Sato et al. |
| 6,158,848 | A | 12/2000 | Liu |
| 6,168,267 | B1 | 1/2001 | Komplin |
| 6,409,322 | B1 | 6/2002 | Ishitsu et al. |
| 6,755,500 | B2 | 6/2004 | Hirano et al. |
| 7,377,628 | B2 | 5/2008 | Oikawa et al. |
| 2007/0222833 | A1 | 9/2007 | Ishizawa et al. |
| 2008/0012915 | A1* | 1/2008 | Ishizawa ..... B41J 2/17513 347/86 |
| 2012/0013687 | A1 | 1/2012 | Ishizawa et al. |
| 2012/0038719 | A1 | 2/2012 | Shimizu et al. |
| 2012/0050359 | A1 | 3/2012 | Koganehira et al. |
| 2012/0188315 | A1* | 7/2012 | Kawate ..... B41J 2/17513 347/87 |

FOREIGN PATENT DOCUMENTS

| | | | | |
|---|---|---|---|---|
| JP | 2012-020497 | A | 2/2012 | |
| JP | 2012-066563 | A | 4/2012 | |
| JP | 2012-152998 | A | 8/2012 | |
| JP | 2012144017 | A * | 8/2012 | ..... B41J 2/17513 |
| JP | 1455512 | S | 11/2012 | |
| JP | 1455916 | S | 11/2012 | |
| JP | 2013-000949 | A | 1/2013 | |
| WO | 207/122793 | A1 | 11/2007 | |

* cited by examiner

LIQUID CONTAINER

TECHNICAL FIELD

The present invention relates to a liquid container.

BACKGROUND ART

An inkjet printer that is one type of a liquid consuming device performs printing on a printing medium such as printing paper by ejecting ink that is one example of a liquid from an ejection head onto the printing medium. A conventionally known configuration of this inkjet printer includes an ink tank provided to store ink and supplies the ink stored in the ink tank to the ejection head (see, for example, Patent Literature 1). This ink tank is provided with an ink inlet port. The user may refill ink from the ink inlet port into the ink tank.

CITATION LIST

Patent Literature

PTL 1: JP 2012-20495A

SUMMARY

Technical Problem

The ink tank described in Patent Literature 1 above includes a liquid chamber configured to contain ink, an air chamber provided to communicate with the liquid chamber and an air introducing port provided to communicate with the air chamber. The air chamber stores the air that is introduced into the liquid chamber. The air introducing port is an air intake to introduce the air into the air chamber. In this ink tank, the balance between the ink and the air is maintained between the liquid chamber and the air chamber in a state that the pressure applied to the ink in the liquid chamber is lower than the atmospheric pressure in the air chamber. Accordingly, in this ink tank, the boundary position between the ink and the air is maintained in between the liquid chamber and the air chamber. In other words, in this ink tank, an ink meniscus is formed on the boundary between the ink and the air in between the liquid chamber and the air chamber.

A vibration or an impact applied to the inkjet printer may, however, break the meniscus of ink and lose the balance between the ink and the air in between the liquid chamber and the air chamber. In this case, the ink in the liquid chamber flows into the air chamber. The ink flowing into the air chamber may be leaked through the air introducing port out of the ink tank. In other words, the prior art liquid container has such a problem that a liquid contained in the liquid container may be leaked outside. This problem is not limited to the liquid container that contains ink but is also commonly found in any liquid container that contains a liquid other than ink.

Solution to Problem

In order to solve at least part of the problems described above, the invention may be implemented by the following aspects or embodiments.

[Aspect 1]

According to one aspect, there is provided a liquid container. The liquid container may comprise a storage chamber configured to contain a liquid; an air chamber provided to communicate with the storage chamber and configured to contain the air that is introduced into the storage chamber; and an air introducing path provided between the air chamber and the storage chamber and configured to introduce the air contained in the air chamber into the storage chamber. A first introducing port may formed to introduce the air into the air chamber is located vertically above a liquid level in the air chamber of the liquid that flows from the storage chamber into the air chamber, in a first attitude that the storage chamber and the air chamber are aligned in a direction intersecting with a vertical direction and that the first introducing port is located vertically above a delivery port which is an air chamber-side opening of the air introducing path.

In the liquid container of this aspect, the first introducing port is located vertically above the liquid level in the air chamber of the liquid that flows from the storage chamber into the air chamber, in the first attitude that the storage chamber and the air chamber are aligned in the direction intersecting with the vertical direction and that the first introducing port is located vertically above the delivery port. This configuration suppresses the liquid in the air chamber from being leaked through the first introducing port out of the liquid container in the first attitude.

[Aspect 2]

In the liquid container of the above aspect, the air introducing path may include a portion extended vertically upward in the first attitude, and a second introducing port which is a storage chamber-side opening of the air introducing path may be provided in the portion extended vertically upward.

In this aspect, the air introducing path includes the portion extended vertically upward in the first attitude, and the second introducing port is provided in the portion extended vertically upward. In the case that the liquid flows through the air introducing path into the air chamber, the second introducing port provided to be protruded vertically above the liquid level of the liquid in the storage chamber stops the inflow of the liquid into the air introducing path. This reduces the amount of the liquid flowing from the storage chamber into the air chamber in the first attitude. This accordingly further suppresses the liquid in the air chamber from flowing from the introducing port into the air introducing path. This configuration thus more effectively suppresses the liquid in the storage chamber from being leaked through the air introducing path out of the liquid container.

[Aspect 3]

In the liquid container of the above aspect, the delivery port may be located vertically above the liquid level in the air chamber in the first attitude.

In this aspect, the delivery port is located vertically above the liquid level in the air chamber in the first attitude. This configuration further suppresses the liquid in the storage chamber from being leaked through the air introducing path out of the liquid container.

[Aspect 4]

In the liquid container of the above aspect, the storage chamber may be a space formed between a first sheet member and a main wall, and the air chamber may be a space formed between the first sheet member and the main wall and separated from the storage chamber by a partition wall. The delivery port may be formed to pass through the main wall and to be open from inside of the air chamber toward outside of the air chamber. The second introducing port may be formed to pass through the main wall and to be open from outside of the storage chamber toward inside of the storage chamber. The air introducing path making the storage chamber communicate with the air chamber may lead from the delivery port to the second introducing port through a surface of the main wall on an opposite side to the air chamber and a surface of the main wall on an opposite side to the storage chamber.

In this aspect, the air introducing path goes through outside of the air chamber and outside of the storage chamber. This increases the capacity of the storage chamber, compared with the configuration that the air introducing path is provided inside of the storage chamber.

[Aspect 5]

In the liquid container of the above aspect, the air introducing path may be a groove that is provided on the surface of the main wall on the opposite side to the air chamber and the surface of the main wall on the opposite side to the storage chamber and is sealed by a second sheet member.

In this aspect, the air in the air chamber is introduced into the storage chamber by the air introducing path configured such that the groove provided in the outer shell of the liquid container is sealed with the second sheet member.

[Aspect 6]

In the liquid container of the above aspect, a first bank may be provided inside of the air chamber to surround the delivery port.

In this aspect, the first bank surrounding the delivery port is provided inside of the air chamber. Even when the liquid flows into the air introducing path, the first bank is likely to interfere with the inflow of the liquid through the air introducing path into the air chamber. This suppresses the liquid flowing into the air introducing path from entering the air chamber and thereby more effectively suppresses the liquid in the storage chamber from being leaked out of the liquid container.

[Aspect 7]

In the liquid container of the above aspect, the first bank may be located to be protruded from a liquid level of the liquid in the storage chamber in a second attitude that the storage chamber and the air chamber are aligned in a direction intersecting with the vertical direction and that the first sheet member is located vertically below the main wall.

This aspect suppresses the liquid in the storage chamber from flowing through the air introducing path and being leaked from the first bank in the air chamber. This more effectively suppresses the liquid in the storage chamber from being leaked out of the liquid container.

[Aspect 8]

In the liquid container of the above aspect, a second bank may be provided inside of the storage chamber to surround the second introducing port.

In this aspect, the second bank surrounding the second introducing port is provided inside of the storage chamber. The second bank is likely to interfere with the inflow of the liquid in the storage chamber through the second introducing port into the air introducing path. This accordingly suppresses the liquid in the storage chamber from flowing into the air chamber.

[Aspect 9]

In the liquid container of the above aspect, the second bank may be located to be protruded from a liquid level of the liquid in the storage chamber in a third attitude that the storage chamber and the air chamber are aligned in a direction intersecting with the vertical direction and that the first sheet member is located vertically below the main wall.

In this aspect, the second bank is provided to be protruded from the liquid level of the liquid in the storage chamber in the third attitude that the storage chamber and the air chamber are aligned in the direction intersecting with the vertical direction and that the first sheet member is located vertically below the main wall. This further suppresses the liquid in the storage chamber from flowing through the second introducing port into the air introducing path in the third attitude and thereby more effectively suppresses the liquid in the storage chamber from flowing into the air chamber.

[Aspect 10]

In the liquid container of the above aspect, the storage chamber may be a space formed between a first sheet member and a main wall, and the air chamber may be a space formed between the first sheet member and the main wall and separated from the storage chamber by a partition wall. The air introducing path may include a first flow path formed along an outer periphery of the air chamber. The first flow path may be formed to be located vertically above the air chamber in an attitude that the storage chamber is located vertically below the air chamber.

In this aspect, at least part of the air introducing path is formed along the outer periphery of the air chamber. The air introducing path is accordingly located vertically above the storage chamber in any of the attitude that the tank is placed such that the second wall faces downward, the attitude that the tank is placed such that the third wall faces downward and the attitude that the tank is placed such that the fourth wall faces downward. This further effectively suppresses the liquid in the storage chamber from flowing into the air chamber.

[Aspect 11]

According to another aspect, there is provided a liquid container. The liquid container may comprise a storage chamber configured to contain a liquid; a inlet port provided to communicate with the storage chamber and configured to fill the storage chamber with the liquid; a supply port provided to communicate with the storage chamber and configured to supply the liquid to outside; an air chamber provided to communicate with the storage chamber and configured to contain an air that is introduced into the storage chamber; and an air introducing path provided between the air chamber and the storage chamber and configured to introduce the air contained in the air chamber into the storage chamber. The air introducing path may include a first flow path formed along an outer periphery of the air chamber. The first flow path may be formed to be located vertically above the air chamber in an attitude that the storage chamber is located vertically below the air chamber.

In this aspect, the air introducing path includes the first flow path formed along the outer periphery of the air chamber. The first flow path is formed to be located vertically above the air chamber in the attitude that the storage chamber is located vertically below the air chamber. This configuration is more likely to suppress the liquid in the storage chamber from flowing into the air chamber.

[Aspect 12]

In the liquid container of the above aspect, the air chamber may be a space formed between a first sheet member and a main wall, and the first flow path may be provided by the first sheet member and an overhang formed along the outer periphery of the air chamber.

In general, the air introducing path is a passage of the air and preferably has such a passage sectional area that does not allow the liquid to readily pass through. This air introducing path has the smaller passage sectional area, compared with the storage chamber configured to contain the liquid. This air introducing path may be easily provided by using the overhang outside of the storage chamber rather than the internal space of the storage chamber. It is more preferable to use the overhang on the outer periphery of the air chamber. This facilitates formation of the air introducing path.

[Aspect 13]

In the liquid container of the above aspect, the overhang may have a thickness in a direction from the main wall toward the first sheet member less than a distance between the main wall and the first sheet member.

In general, the air introducing path is a passage of the air and preferably has such a passage sectional area that does not allow the liquid to readily pass through. This air introducing path has the smaller passage sectional area, compared with the storage chamber configured to contain the liquid. This air introducing path may be easily provided by forming the overhang on the outer periphery of the air chamber to have the thickness less than the distance between the main wall and the first sheet member. This facilitates formation of the air introducing path.

[Aspect 14]

In the liquid container of the above aspect, the air introducing path may connect with the first flow path and include a second flow path formed along the outer periphery of the air chamber. The second flow path may be located vertically above the air chamber in an attitude that the storage chamber and the air chamber are aligned in a direction intersecting with a vertical direction.

In this aspect, the second flow path is located vertically above the air chamber in the attitude that the storage chamber and the air chamber are aligned in the direction intersecting with the vertical direction. This configuration more effectively suppresses the liquid in the storage chamber from flowing into the air chamber.

[Aspect 15]

In the liquid container of the above aspect, the air introducing path may connect with the first flow path and include a third flow path formed along the outer periphery of the air chamber. The third flow path may be located on an opposite side to the second flow path across the air chamber.

In this aspect, the air introducing path connects with the first flow path and includes the third flow path formed along the outer periphery of the air chamber. The third flow path is located on the opposite side to the second flow path across the air chamber. This configuration more effectively suppresses the liquid in the storage chamber from flowing into the air chamber.

[Aspect 16]

The liquid container of the above aspect may further comprise a supply tube connecting with the supply port.

This aspect includes the tube connecting with the supply port. This enhances the flexibility in the configuration of supplying the liquid in the storage chamber to outside.

DESCRIPTION OF EMBODIMENTS

Figure 1:
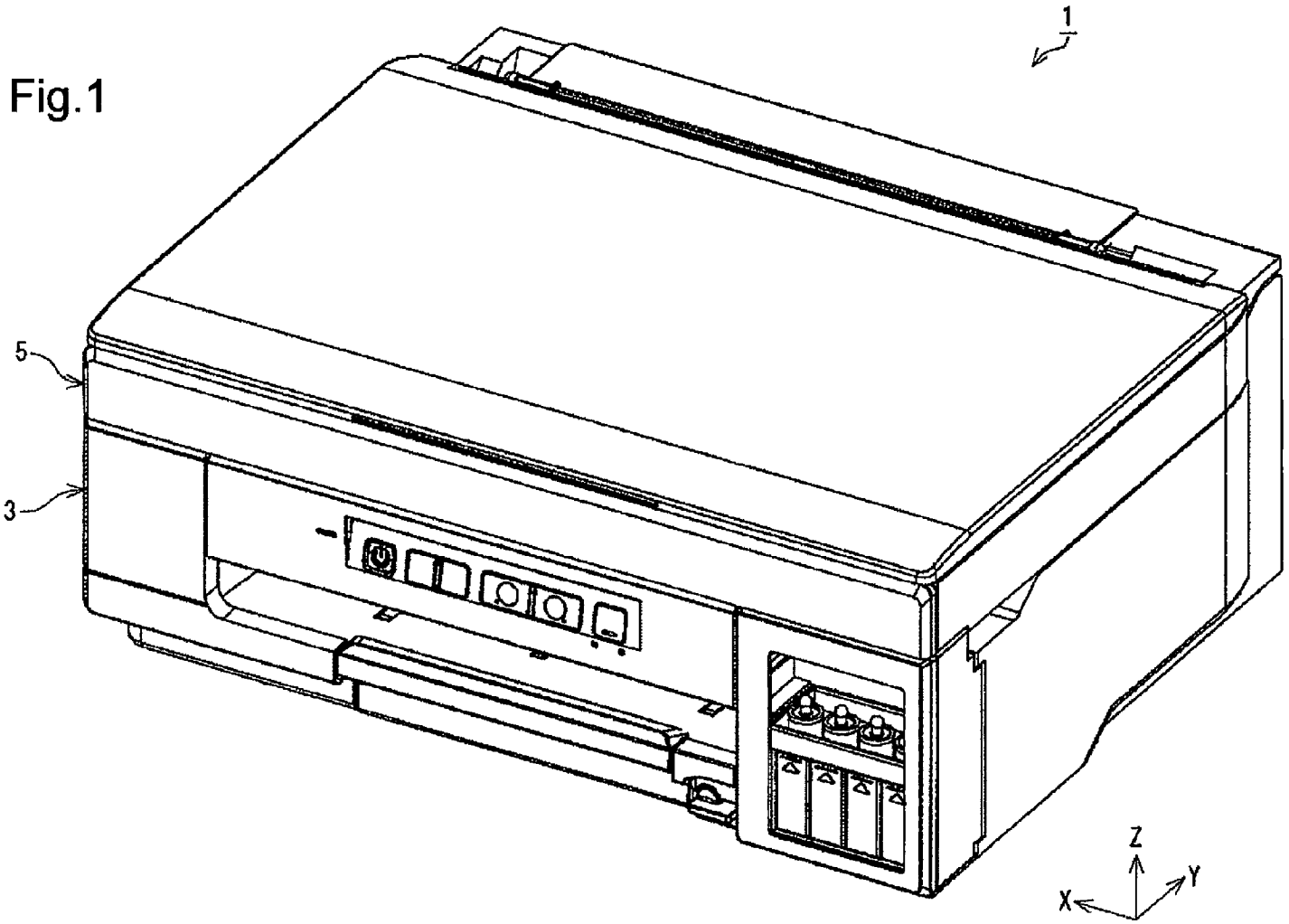
FIG. 1 is a perspective view illustrating a multifunction printer according to an embodiment.

The following describes a multifunction printer as one example of a liquid consuming device according to an embodiment with reference to drawings. The multifunction printer 1 of the embodiment includes a printer 3 and a scanner unit 5 as shown in FIG. 1. In the multifunction printer 1, the printer 3 and the scanner unit 5 are stacked. In the use state of the printer 3, the scanner unit 5 is placed vertically on the printer 3. XYZ axes as coordinate axes that are orthogonal to one another are shown in FIG. 1. The XYZ axes are also added as appropriate in subsequent drawings. In the state of FIG. 1, the printer 3 is placed on a horizontal plane (XY plane) defined by an X-axis direction and a Y-axis direction. A Z-axis direction is a direction orthogonal to the XY plane, and −Z-axis direction represents vertically downward.

Figure 2:
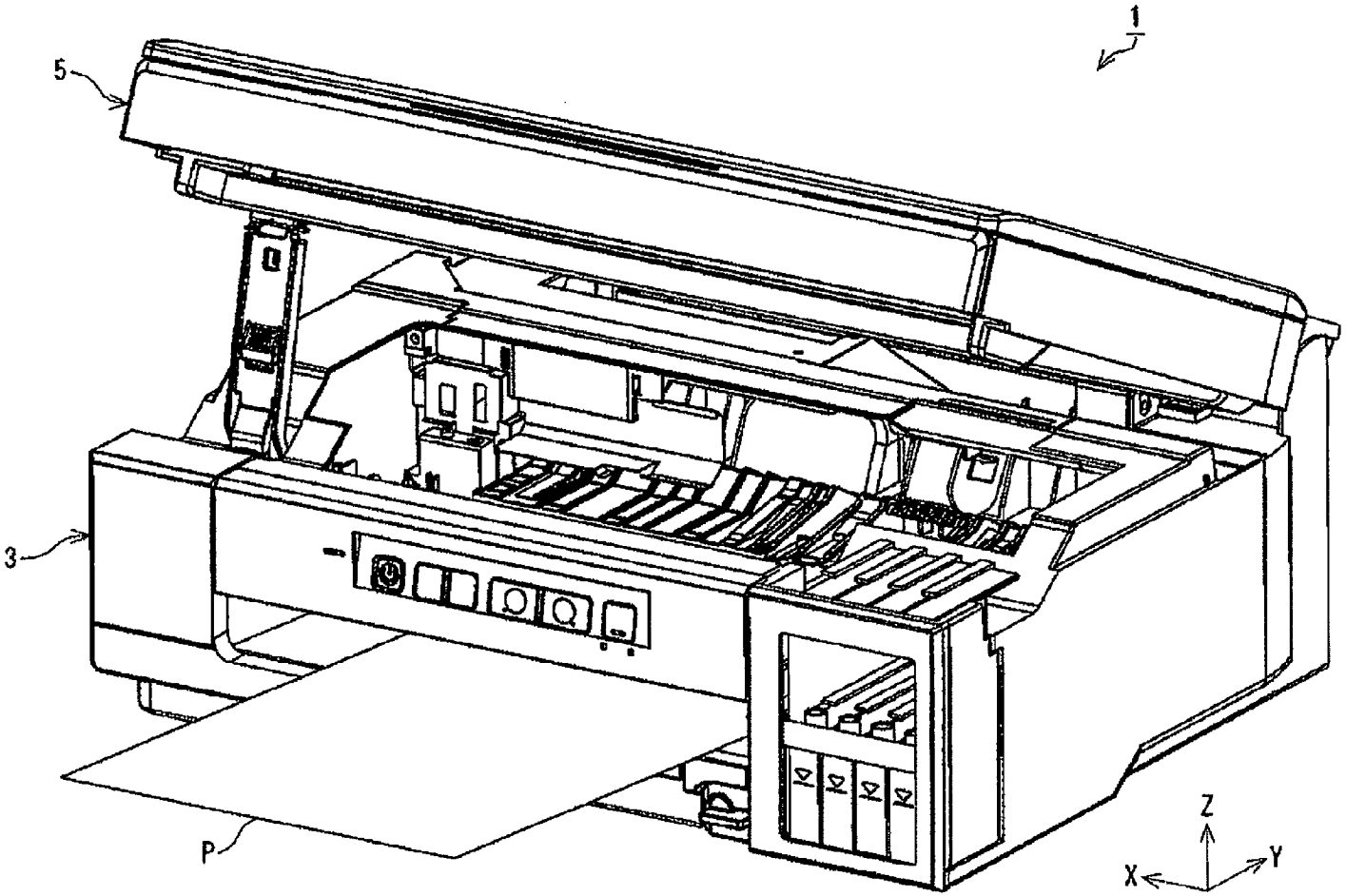
FIG. 2 is a perspective view illustrating the multifunction printer of the embodiment.

The scanner unit 5 is flatbed type having an imaging element (not shown) such as an image sensor, a platen and a cover. The scanner unit 5 is capable of reading an image or the like recorded on a medium such as paper via the imaging element in the form of image data. The scanner unit 5 accordingly serves as a reader of the image or the like. As shown in FIG. 2, the scanner unit 5 is provided to be rotatable relative to a casing 7 of the printer 3. A printer 3-side surface of the platen of the scanner unit 5 also serves as a cover of the printer 3 to cover the casing 7 of the printer 3.

Figure 3:
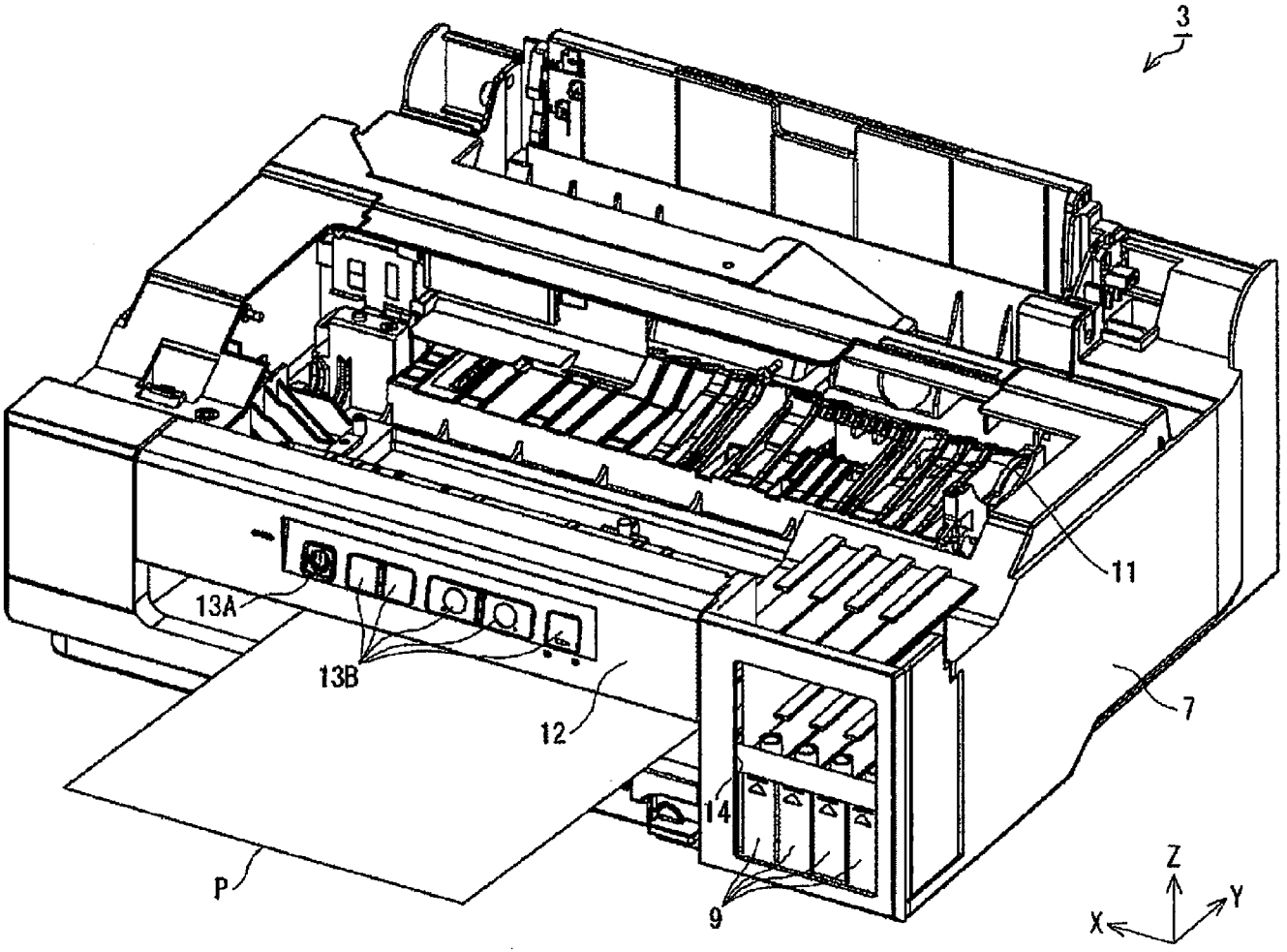
FIG. 3 is a perspective view illustrating a printer of the embodiment.

The printer 3 performs printing on a printing medium P such as printing paper with ink as one example of liquid. As shown in FIG. 3, the printer 3 includes the casing 7 and a plurality of tanks 9 as one example of liquid containers. The casing 7 is an integrally molded component that forms an outer shell of the printer 3 and includes mechanics 11 of the printer 3. The plurality of tanks 9 are placed inside of the casing 7 to respectively contain inks used for printing. This embodiment provides four tanks 9. The four tanks 9 respectively contain different inks. This embodiment employs four different inks, i.e., black, yellow, magenta and cyan. Each of the four tanks 9 is provided to contain a different ink.

The printer 3 also has an operation panel 12. The operation panel 12 is provided with a power button 13A and other operation buttons 13B. An operator who operates the printer 3 faces the operation panel 12 to operate the power button 13A and the operation buttons 13B. A front face of the printer 3 is a surface where the operation panel 12 is provided. The casing 7 has a window 14 provided on the front face of the printer 3. The window 14 has optical transparency. The four tanks 9 described above are placed at a position overlapping the window 14. This configuration enables the operator to observe the four tanks 9 through the window 14.

According to this embodiment, a region of each of the tank 9 facing the window 9 has optical transparency, so that ink contained in the tank 9 is visible through the region of the tank 9 having optical transparency. This enables the operator to observe the four tanks 9 through the window 14 and thereby visually check the amounts of inks remaining in the respective tanks 9. According to this embodiment, the window 14 is provided on the front surface of the printer 3. This configuration enables the operator facing the operation panel 12 to visually recognize the respective tanks 9 through the window 14. This accordingly enables the operator to check the remaining amounts of inks in the respective tanks 9 while operating the printer 3.

Figure 4:
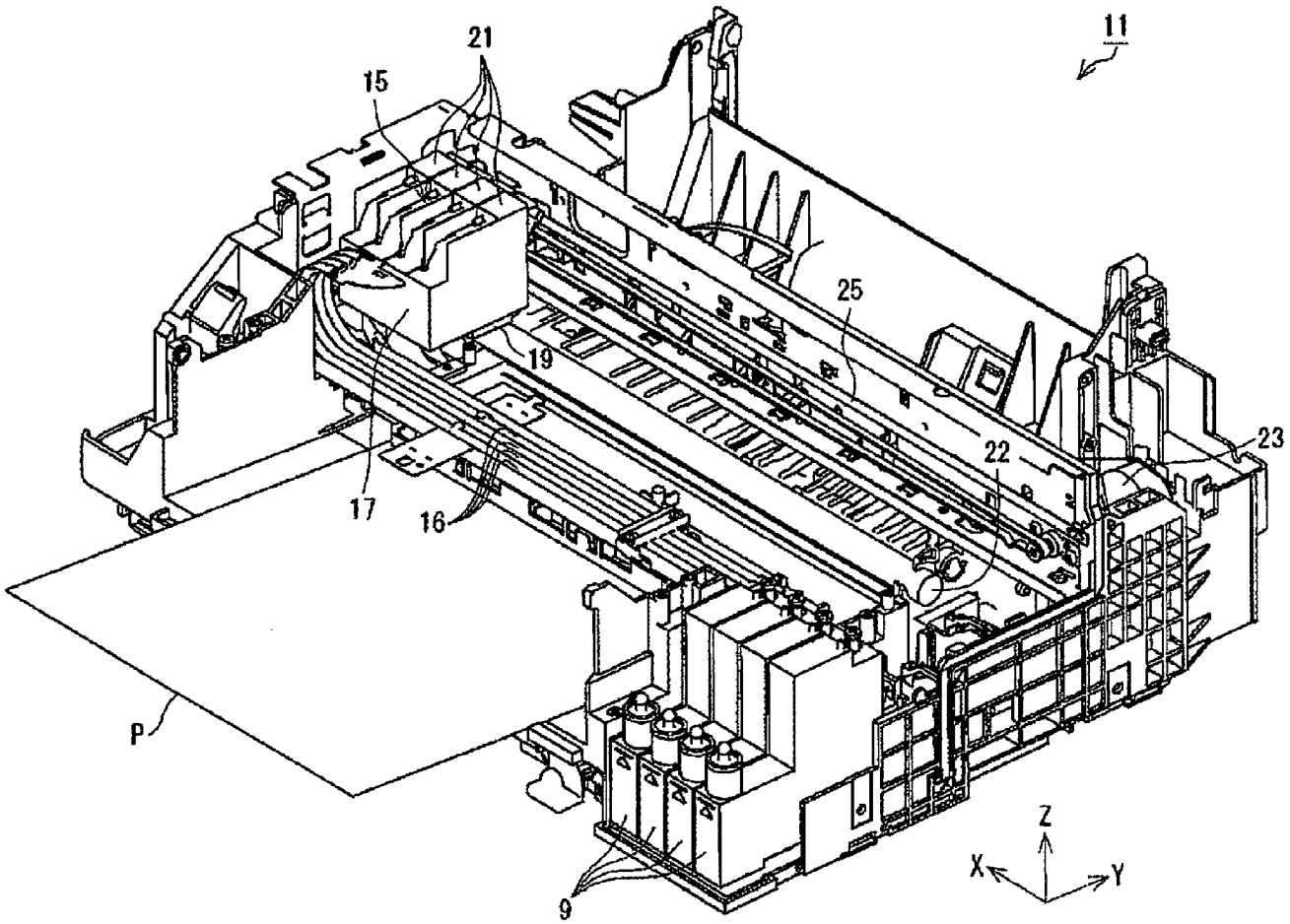
FIG. 4 is a perspective view illustrating mechanics of the printer of the embodiment.

As shown in FIG. 4 that is a schematic diagram of the mechanics 11, the printer 3 includes a printing assembly 15 and supply tubes 16. The printing assembly 15 includes a carriage 17, an ejection head 19 and four relay units 21. The ejection head 19 and the four relay units 21 are mounted on the carriage 17. The supply tubes 16 are flexible and are provided between the tanks 9 and the relay units 21. The ink contained in each of the tanks 9 is supplied through the supply tube 16 to the relay unit 21. The relay unit 21 relays the ink which is supplied from the tank 9 through the supply tube 16, to the ejection head 19. The ejection head 19 ejects the supplied ink in the form of ink droplets.

The printer 3 also has a medium feeding mechanism (not shown) and a head carrying mechanism (not shown). The medium feeding mechanism drives a feed roller 22 by the power from a motor (not shown), so as to feed a printing medium P in the Y-axis direction. The head carrying mechanism transmits the power from a motor 23 via a timing belt 25 to the carriage 17, so as to carry the carriage 17 along the X-axis direction. As described above, the ejection head 19 is mounted on the carriage 17. The ejection head 19 is thus movable in the X-axis direction via the carriage 17 by the head carrying mechanism. The medium feeding mechanism and the head carrying mechanism cause ink to be ejected from the ejection head 19 while changing the position of the ejection head 19 relative to the printing medium P, so as to complete printing on the printing medium P.

[First Embodiment]

Figure 5:
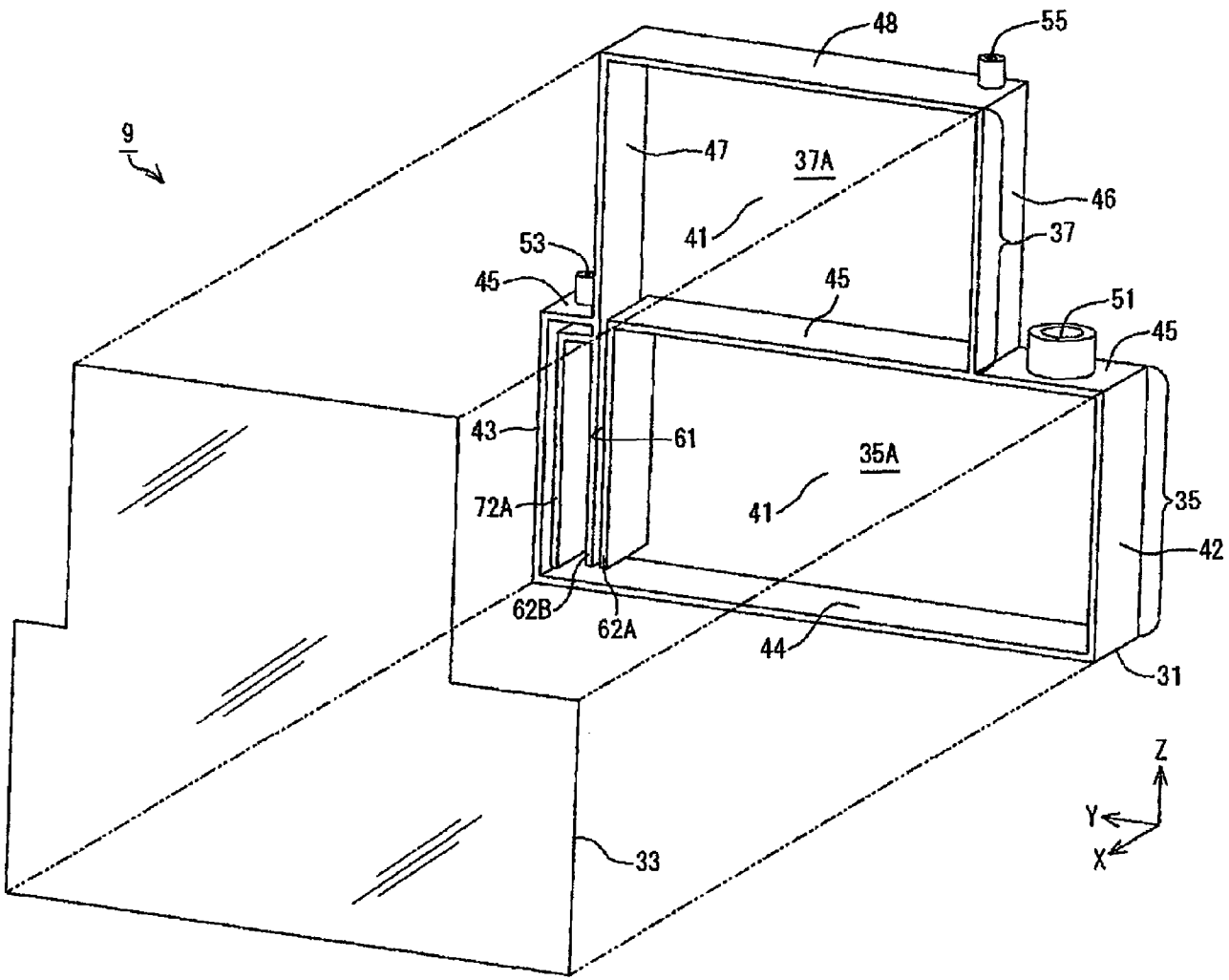
FIG. 5 is an exploded perspective view illustrating the schematic configuration of a tank according to a first embodiment.

The tank 9 has a casing 31 and a sheet member 33 as one example of the first sheet member as shown in FIG. 5. The casing 31 is made of a synthetic resin such as nylon or polypropylene. The sheet member 33 is made of a synthetic resin (for example, nylon or polypropylene) in a film-like shape and has flexibility. The casing 31 includes a container portion 35 and an air chamber 37.

The container portion 35 includes first wall 41, a second wall 42, a third wall 43, a fourth wall 44 and a fifth wall 45. The second wall 42, the third wall 43, the fourth wall 44 and the fifth wall 45 are arranged to intersect with the first wall 41 respectively. The second wall 42 and the third wall 43 are located to face each other across the first wall 41 in the Y-axis direction. The fourth wall 44 and the fifth wall 45 are located to face each other across the first wall 41 in the Z-axis direction. The second wall 42 intersects with both the fourth wall 44 and the fifth wall 45. The third wall 43 also intersects with both the fourth wall 44 and the fifth wall 45.

In the planar view, the first wall 41 is surrounded by the second wall 42, the third wall 43, the fourth wall 44 and the fifth wall 45. The second wall 42, the third wall 43, the fourth wall 44 and the fifth wall 45 are protruded from the first wall 41 in the +X-axis direction. Accordingly, the container portion 35 is formed in a recessed shape by the first wall 41 as main wall and the second wall 42, the third wall 43, the fourth wall 44 and the fifth wall 45 extended vertically from the main wall. A recess 35A is formed by the first wall 41, the second wall 42, the third wall 43, the fourth wall 44 and the fifth wall 45. The recess 35A is formed to be concave in the −X-axis direction. The recess 35A is open in the +X-axis direction, i.e., on the sheet member 33-side. Ink is contained in the recess 35A. The first wall 41, the second wall 42, the third wall 43, the fourth wall 44 and the fifth wall 45 are not limited to flat walls but may have some concavo-convex shapes.

The air chamber 37 is provided on the fifth wall 45. The air chamber 37 is protruded from the fifth wall 45 on an opposite side to a fourth wall 44-side of the fifth wall 45, i.e., on a +Z-axis direction side of the fifth wall 45. The air chamber 37 includes a first wall 41, a fifth wall 45, a sixth wall 46, a seventh wall 47 and an eighth wall 48. The first wall 41 of the container portion 35 is identical with the first wall 41 of the air chamber 37. In other words, according to this embodiment, the container portion 35 and the air chamber 37 share the first wall 41.

The sixth wall 46 is protruded from the fifth wall 45 on the opposite side to the fourth wall 44-side of the fifth wall 45, i.e., on the +Z-axis direction side of the fifth wall 45. The seventh wall 47 is protruded from the fifth wall 45 on the opposite side to the fourth wall 44-side of the fifth wall 45, i.e., on the +Z-axis direction side of the fifth wall 45. The sixth wall 46 and the seventh wall 47 are located to face each other across the first wall 41 of the air chamber 37 in the Y-axis direction. The eighth wall 48 is located to face the fifth wall 45 across the first wall 41 of the air chamber 37 in the Z-axis direction. The sixth wall 46 intersects both the fifth wall 45 and the eighth wall 48. The seventh wall 47 also intersects both the fifth wall 45 and the eighth wall 48.

In the planar view, the first wall 41 of the air chamber 37 is surrounded by the fifth wall 45, the sixth wall 46, the seventh wall 47 and the eighth wall 48. The fifth wall 45, the sixth wall 46, the seventh wall 47 and the eighth wall 48 are protruded from the first wall 41 in the +X-axis direction. Accordingly, the air chamber 37 is formed in a recessed shape by the first wall 41 as main wall and the fifth wall 45, the sixth wall 46, the seventh wall 47 and the eighth wall 48 extended vertically from the main wall. A recess 37A of the air chamber 37 is formed by the first wall 41, the fifth wall 45, the sixth wall 46, the seventh wall 47 and the eighth wall 48. The recess 37A is formed to be concave in the −X-axis direction. The recess 37A is open in the +X-axis direction, i.e., on the sheet member 33-side. The recess 35A and the recess 37A are separated from each other by the fifth wall 45 as partition wall. The amounts of protrusion of the second wall 42 to the eighth wall 48 from the first wall 41 are set to an identical protrusion amount.

The second wall 42 and the sixth wall 46 form a step in the Y-axis direction. The sixth wall 46 is located on the third wall 43-side of the second wall 42, i.e., on the +Y-axis direction side of the second wall 42. The third wall 43 and the seventh wall 47 form a step in the Y-axis direction. The seventh wall 47 is located on the second wall 42-side of the third wall 43, i.e., on the −Y-axis direction side of the third wall 43. In the planar view of the first wall 41, an inlet port 51 is provided between the second wall 42 and the sixth wall 46. In the planar view of the first wall 41, a supply port 53 is provided between the third wall 43 and the seventh wall 47. The inlet port 51 and the supply port 53 are placed on the fifth wall 45. The inlet port 51 and the supply port 53 are respectively arranged to make outside of the casing 31 communicate with inside of the recess 35A.

Figure 6:
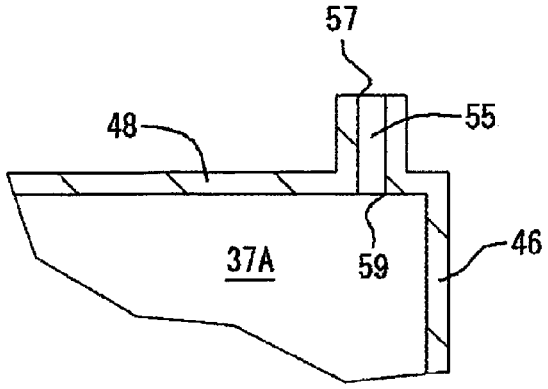
FIG. 6 is a sectional view illustrating a first air introducing path of the first embodiment cut along a YZ plane.

The eighth wall 48 has a first air introducing path 55. The first air introducing path 55 is protruded from the eighth wall 48 on an opposite side to a fifth wall 45-side of the eighth wall 48, i.e., on a Z-axis direction side of the eighth wall 48. The first air introducing path 55 is arranged to make outside of the casing 31 communicate with inside of the recess 35A. The first air introducing path 55 is an air passage to introduce the air outside of the casing 31 to inside of the recess 35A. As shown in FIG. 6 that is a sectional view of the first air introducing path 55 cut along a YZ plane, the first air introducing path 55 includes an air communication port 57 and a first introducing port 59. The air communication port 57 is an opening that is open outward the casing 31. The first introducing port 59 is an opening that is open inward the recess 37A. The air outside of the casing 31 flows from the air communication port 57 as inlet of the first air introducing path 55 to enter the first air introducing path 55. The air entering the first air introducing path 55 is introduced by the first air introducing path 55 toward the air chamber 37 and is flowed out from the first introducing port 59 as outlet of the first air introducing path 55 to the air chamber 37.

This embodiment employs the configuration that the first air introducing path 55 is protruded from the eighth wall 48 outward the casing 31. The configuration of the first air introducing path 55 is, however, not limited to this configuration. In another employable configuration, the first air introducing path 55 is not protruded from the eighth wall 48 or more specifically the end of the first air introducing path 55 is placed on the fifth wall 45-side of the eighth wall 48. In the latter configuration, the first air introducing path 55 may be placed in the thickness of the eighth wall 48 or may be protruded from the eighth wall 48 into the recess 37A. For example, providing a hole penetrated from outside of the casing 31 to the recess 37A causes the length of the first air introducing path 55 to be equal to the thickness of the eighth wall 48. In the application that the length of the first air introducing path 55 is equal to the thickness of the eighth wall 48, the air communication port 57 is open on an opposite side surface to a fifth wall 45-side of the eighth wall 48, and the first introducing port 59 is open on a fifth wall 45-side surface of the eighth wall 48.

As shown in FIG. 5, a second air introducing path 61 is provided in the casing 31 to make the recess 37A and the recess 35A communicate with each other. The second air introducing path 61 is parted by a partition wall 62A and a partition wall 62B in the recess 35A. The partition wall 62A and the partition wall 62B are respectively protruded from the first wall 41 in the +X-axis direction, i.e., from the first wall 41 toward the sheet member 33 in the recess 35A. Accordingly, the second air introducing path 61 is formed as a groove by the first wall 41, the partition wall 62A and the partition wall 62B. The amounts of protrusion of the partition wall 62A and the partition wall 62B from the first wall 41 are set to be equal to the protrusion amount of the second wall 42 to the eighth wall 48.

Figure 7:
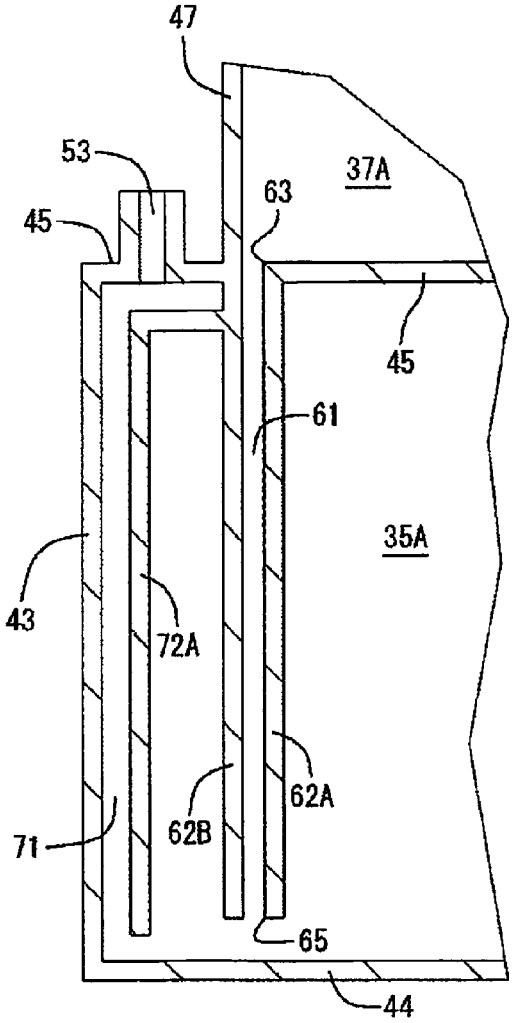
FIG. 7 is a sectional view illustrating a second air introducing path and a supply port of the first embodiment cut along the YZ plane.

As shown in FIG. 7 that is a sectional view of the second air introducing path 61 and the supply port 53 cut along the YZ plane, the second air introducing path 61 includes a delivery port 63 and a second introducing port 65. The delivery port 63 is an opening that is open inward the recess 37A. The second introducing port 65 is an opening that is open inward the recess 35A. The air inside of the recess 37A flows from the delivery port 63 as inlet of the second air introducing path 61 to enter the second air introducing path 61. The air entering the second air introducing path 61 is introduced by the second air introducing path 61 toward the recess 35A and is flowed out from the second introducing port 65 as outlet of the second air introducing path 61 to the recess 35A.

As shown in FIG. 7, a supply path 71 is provided between the partition wall 62B and the third wall 43. The supply path 71 is a flow path arranged to make inside of the recess 35A communicate with the supply port 53. The supply path 71 is parted by a partition wall 72A and the third wall 43 in the recess 35A. The partition wall 72A is protruded from the first wall 41 in the +X-axis direction, i.e., from the first wall toward the sheet member 33, in the recess 35A as shown in FIG. 5. Accordingly, the supply path 71 is formed as a groove by the first wall 41, the partition wall 72A and the third wall 43. The amount of protrusion of the partition wall 72A from the first wall 41 is set to be equal to the protrusion amount of the second wall 42 to the eighth wall 48 from the first wall 41.

As shown in FIG. 5, the sheet member 33 is arranged to face the first wall 41 across the second wall 42 to the eighth wall 48 in the X-axis direction. In the planar view, the sheet member 33 has dimensions to cover the recess 35A and the recess 37A. The sheet member 33 is joined with respective ends of the second wall 42 to the eighth wall 48, the partition wall 62A, the partition wall 62B and the partition wall 72A with keeping a clearance from the first wall 41. The recess 35A and the recess 37A are accordingly sealed by the sheet member 33. The sheet member 33 may thus be regarded as a cover for the casing 31.

Figure 8:
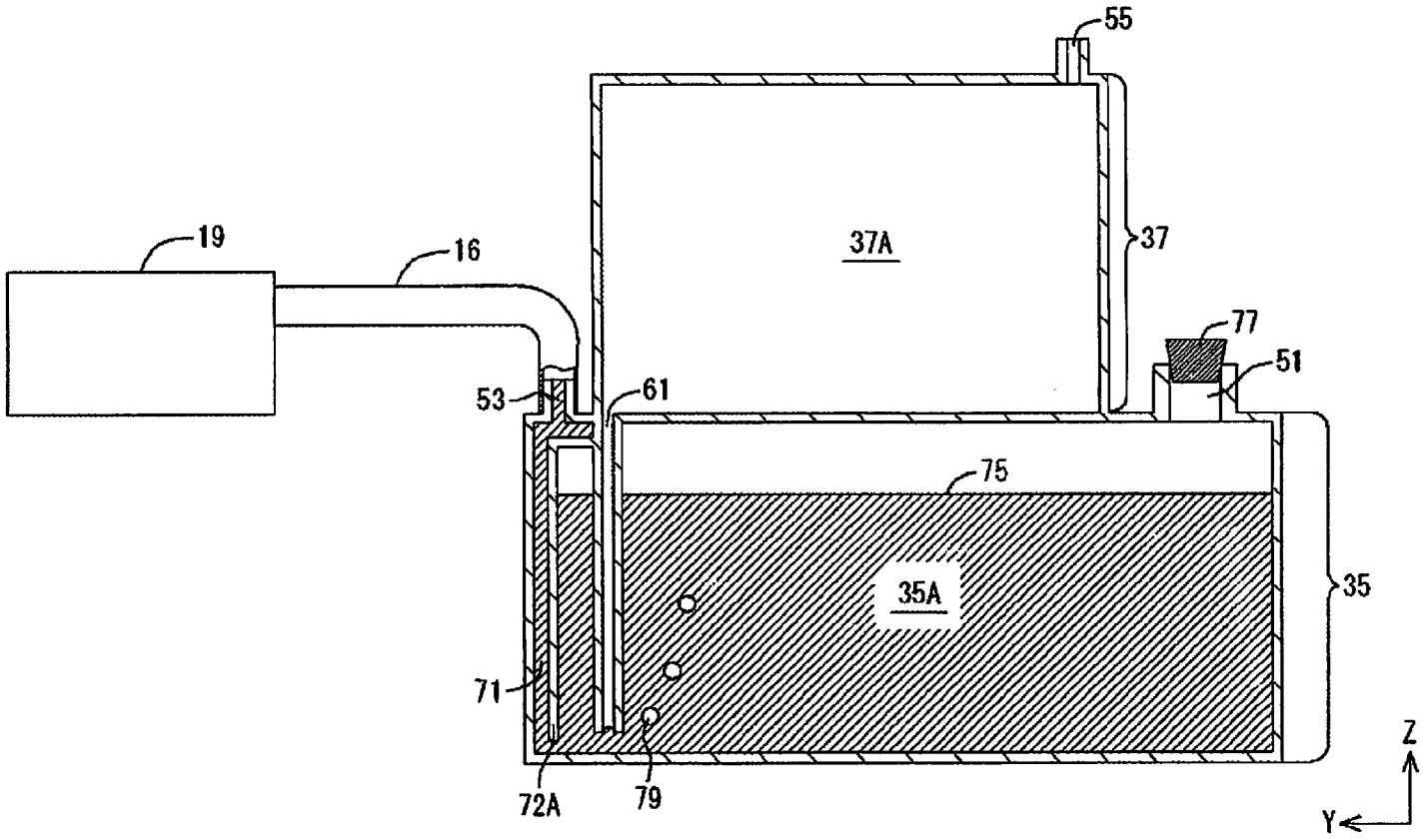
FIG. 8 is a sectional view illustrating an inlet port, the air introducing paths and the supply port of the first embodiment cut along the YZ plane.

As shown in FIG. 8 that is a sectional view of the first air introducing path 55 and the supply port 53 cut along the YZ plane, ink 75 is contained inside of the recess 35A in the tank 9. The ink 75 in the recess 35A flows through the supply path 71 and is supplied from the supply port 53 to the ejection head 19. According to this embodiment, in the use state of the printer 3 for printing, the supply tube 16 is connected with the supply port 53, and the inlet port 51 is closed by a plug 77. The ink 75 in the recess 35A is flowed through the supply port 53 to reach the ejection head 19 by suction of inside of the supply path 71 via the ejection head 19 in the state that the partition wall 72A is submerged in the ink 75.

The ink 75 in the recess 35A is supplied to the ejection head 19 with progress in printing by means of the ejection head 19. The internal pressure of the recess 35A accordingly becomes lower than the atmospheric pressure with progress in printing by means of the ejection head 19. As the internal pressure of the recess 35A becomes lower than the atmospheric pressure, the air 79 in the recess 37A is flowed through the second air introducing path 61 into the recess 35A. The internal pressure of the recess 35A is thus more likely to be maintained at the atmospheric pressure.

The ink 75 in the tank 9 is supplied to the ejection head 19 as described above. When the ink 75 in the recess 35A of the tank 9 is consumed to a small remaining amount, the operator is allowed to refill the recess 35A with new ink supplied from the inlet port 51. In the use state of the printer 3 for printing, the inlet port 51 is located vertically below the air communication port 57, i.e., on a −Z-axis direction side of the air communication port 57 in the tank 9. Accordingly, even when the recess 35A is filled with the ink 75, this configuration suppresses the ink from overflowing from the recess 35A through the first air introducing path 55 into the recess 37A.

Figure 9:
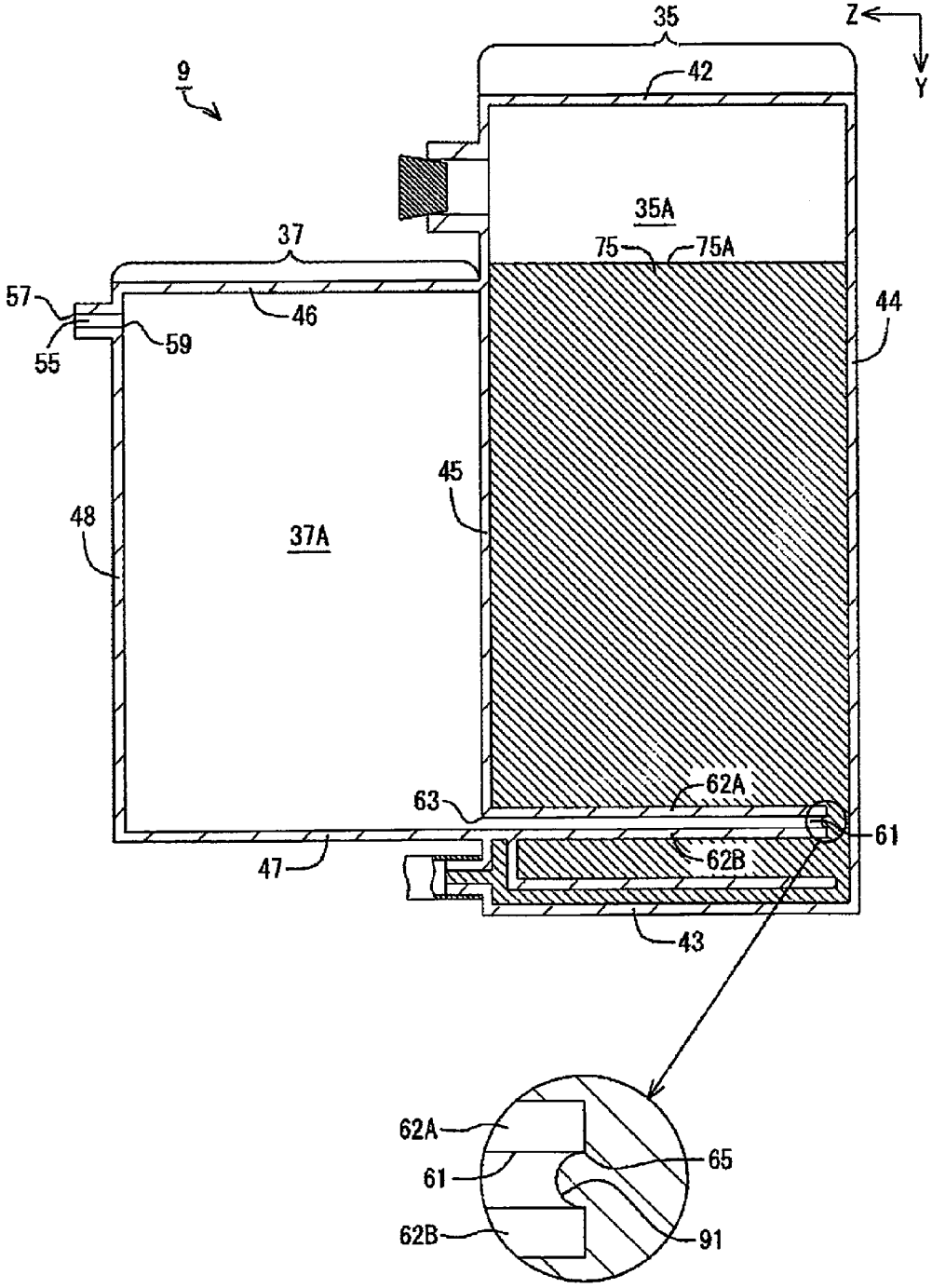
FIG. 9 is a sectional view illustrating the tank in a first attitude of the first embodiment.

The printer 3 may not be installed at one fixed location but may be transferred to another location. During such transfer, the attitude of the printer 3 is unspecified. In this case, when the ink 75 remains in the tank 9, the ink 75 is likely to flow from the recess 35A into the recess 37A and to be eventually leaked through the first air introducing path 55 out of the tank 9. In this embodiment, for example, in the attitude of the printer 3, the tank 9 may be inclined such that the +Y-axis direction faces vertically downward as shown in FIG. 9. This attitude corresponds to an attitude that the container portion 35 and the air chamber 37 are aligned in a direction intersecting a vertical direction and that the first introducing port 59 of the first air introducing path 55 is located vertically above the delivery port 63 of the second air introducing path 61 (hereinafter called first attitude).

According to this embodiment, even in the above first attitude, in the steady state, a meniscus 91 is maintained in the second air introducing path 61 as shown in an enlarged view. This suppresses the ink 75 in the recess 35A from entering the recess 37A in the steady state even when the tank 9 is inclined in the first attitude that the +Y-axis direction faces vertically downward.

Figure 10:
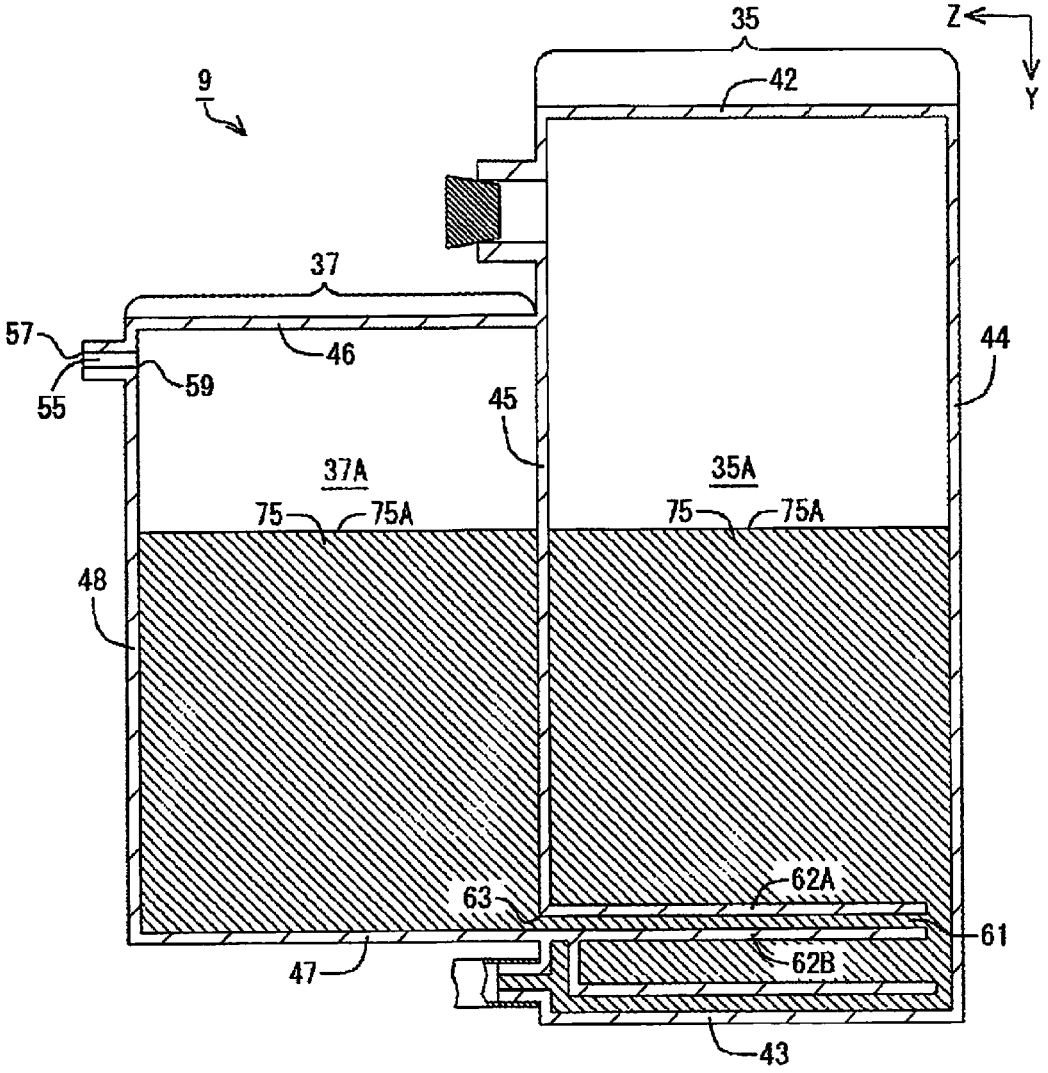
FIG. 10 is a sectional view illustrating the tank in the first attitude of the first embodiment.

The meniscus 91 in the second air introducing path 61 may, however, be broken by application of, for example, a vibration or an impact on the printer 3. As the meniscus 91 in the second air introducing path 61 is broken, the ink 75 in the recess 35A flows through the second air introducing path 61 to enter the recess 37A as shown in FIG. 10. FIG. 10 shows the state that inside of the recess 35A (container portion 35) is filled with the ink 75. According to this embodiment, the first introducing port 59 is provided to be located vertically above a liquid level 75A of the ink 75 in the recess 37A in the first attitude. This configuration of the embodiment is thus more likely to suppress the ink 75 from leaking through the first air introducing path 55 out of the tank 9 even in the state of FIG. 10.

Figure 11:
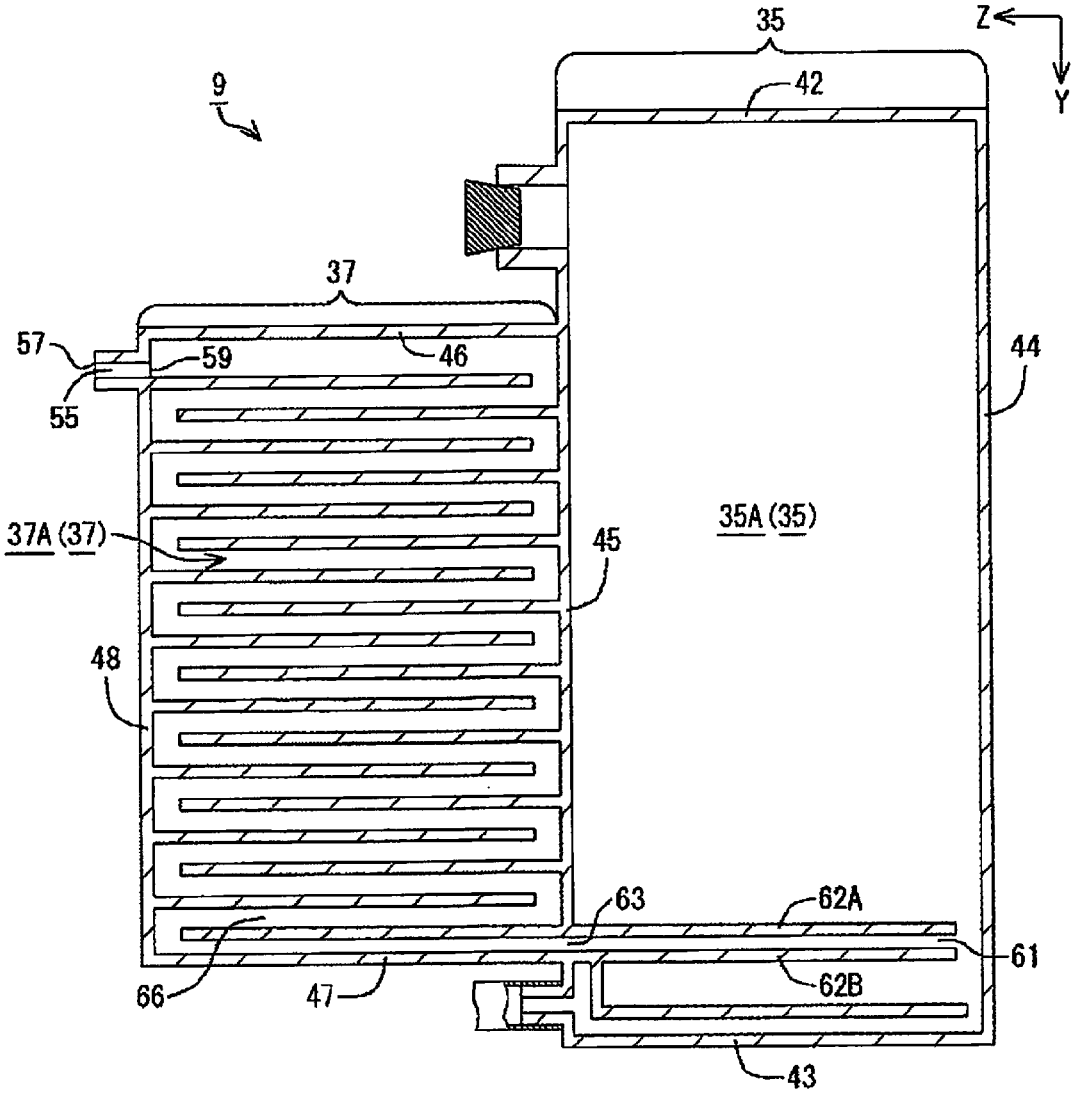
FIG. 11 is a diagram illustrating another internal configuration of an air chamber according to a modification of the first embodiment.
Figure 12:
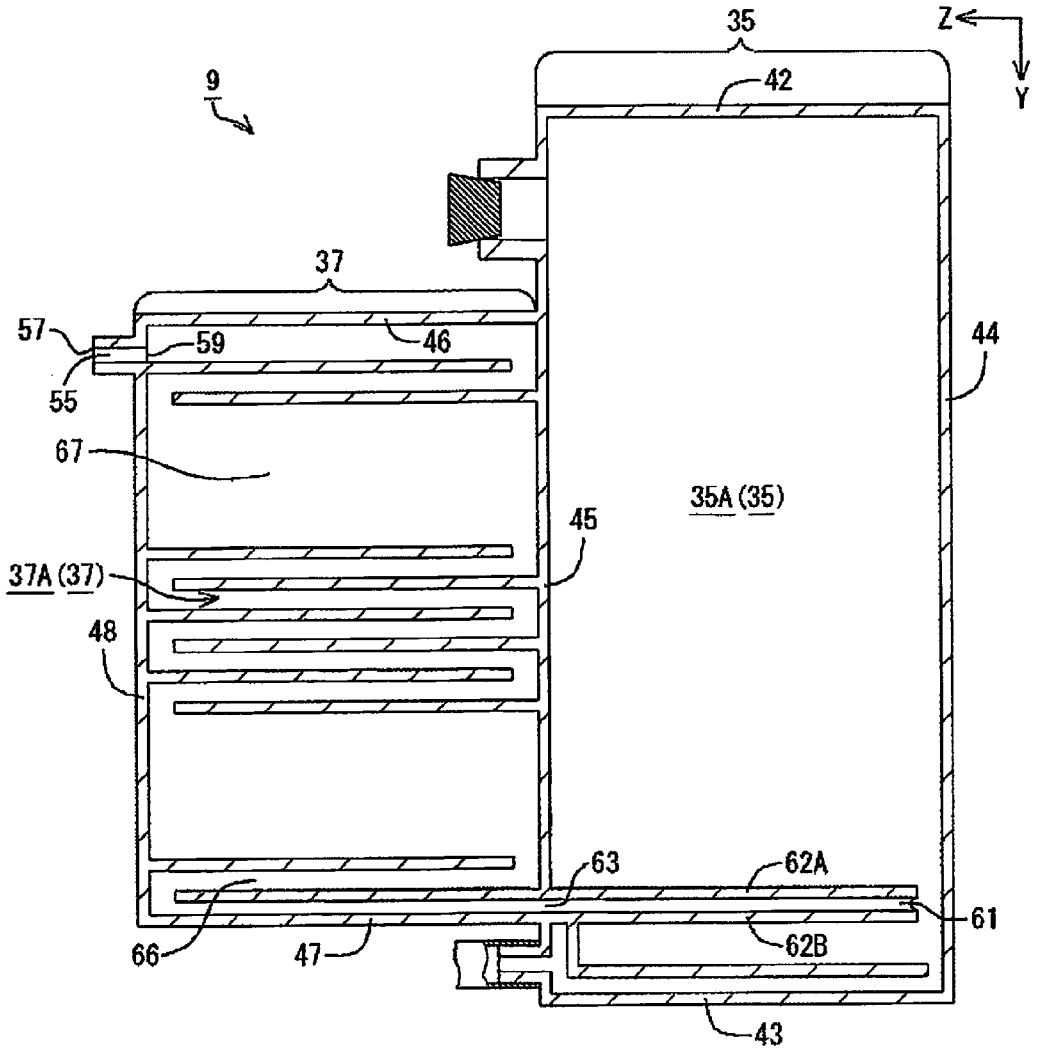
FIG. 12 is a diagram illustrating another internal configuration of the air chamber according to another modification of the first embodiment.

In this embodiment, the internal configuration of the air chamber 37 is not limited to the configuration shown in FIG. 8. For example, the internal configuration of the air chamber 37 may include an air flow path 66 formed in a serpentine shape to communicate with the delivery port 63 of the second air introducing path 61 as shown in FIG. 11. This configuration reduces the likelihood that the ink 75 flowing from the delivery port 63 into the air chamber 37 reaches the first introducing port 59. In another example, the internal configuration of the air chamber 37 may include an air buffer chamber 67 formed in the middle of the air flow path 66 as shown in FIG. 12. This configuration traps the moving ink 75 that has reached the air flow path 66 and further reduces the likelihood that the ink 75 reaches the first introducing port 59. Any of such internal configurations of the air chamber 37 described above with regard to the first embodiment may be applied to other embodiments of the invention.

[Second Embodiment]

Figure 13:
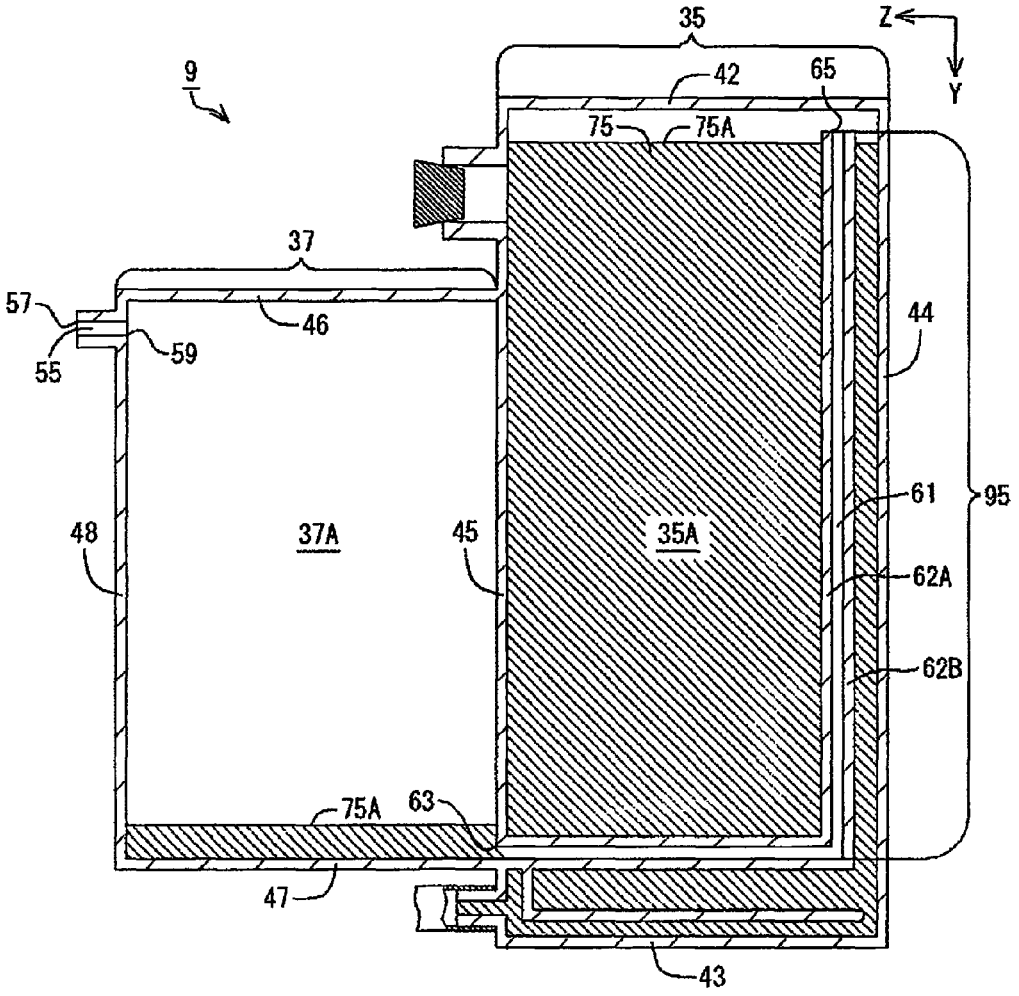
FIG. 13 is a sectional diagram illustrating a tank in the first attitude according to a second embodiment.

The following describes a tank 9 according to a second embodiment. The tank 9 of the second embodiment has a similar configuration to that of the tank 9 of the first embodiment, except that a second air introducing path 61 in the casing 31 includes a portion 95 extended along the fourth wall 44 toward the second wall 42 in the first attitude as shown in FIG. 13. The like components to those of the first embodiment are thus expressed by the like signs to those of the first embodiment and are not specifically described.

In the second embodiment, a partition wall 62B is extended along the Z-axis direction from the fifth wall 45 toward the fourth wall 44 and is bent before reaching the fourth wall 44. The partition wall 62B extended from the fifth wall 45 and bent before the fourth wall 44 is extended along the Y-axis direction toward the second wall 42, i.e., extended vertically upward in the first attitude with keeping a clearance from the fourth wall 44. A partition wall 62A is extended along the Z-axis direction from the fifth wall 45 toward the fourth wall 44 and is bent before reaching the fourth wall 44 and reaching the partition wall 62B. The partition wall 62A extended from the fifth wall 45 and bent before the partition wall 62B is extended along the Y-axis direction toward the second wall 42, i.e., extended vertically upward in the first attitude with keeping a clearance from the partition wall 62B. The second air introducing path 61 has a capacity smaller than the capacity of the recess 37A (air chamber 37).

According to the second embodiment, when the ink 75 in the recess 35A flows through the second air introducing path 61 into the recess 37A in the first attitude, locating the second introducing port 65 to be protruded in the vertical direction above the liquid level 75A of the ink 75 stops the outflow of the ink 75 into the recess 37A. This configuration reduces the amount of the ink 75 flowing through the second air introducing path 61 into the recess 37A, compared with the first embodiment. This configuration of the second embodiment more effectively suppresses the ink 75 from being leaked through the first air introducing path 55 out of the tank 9. In the second embodiment, locating the second air introducing path 61 to be protruded in the vertical direction above the liquid level 75A of the ink 75 in the recess 35 in the first attitude further reduces the amount of the ink 75 flowing into the recess 37A.

[Third Embodiment]

Figure 14:
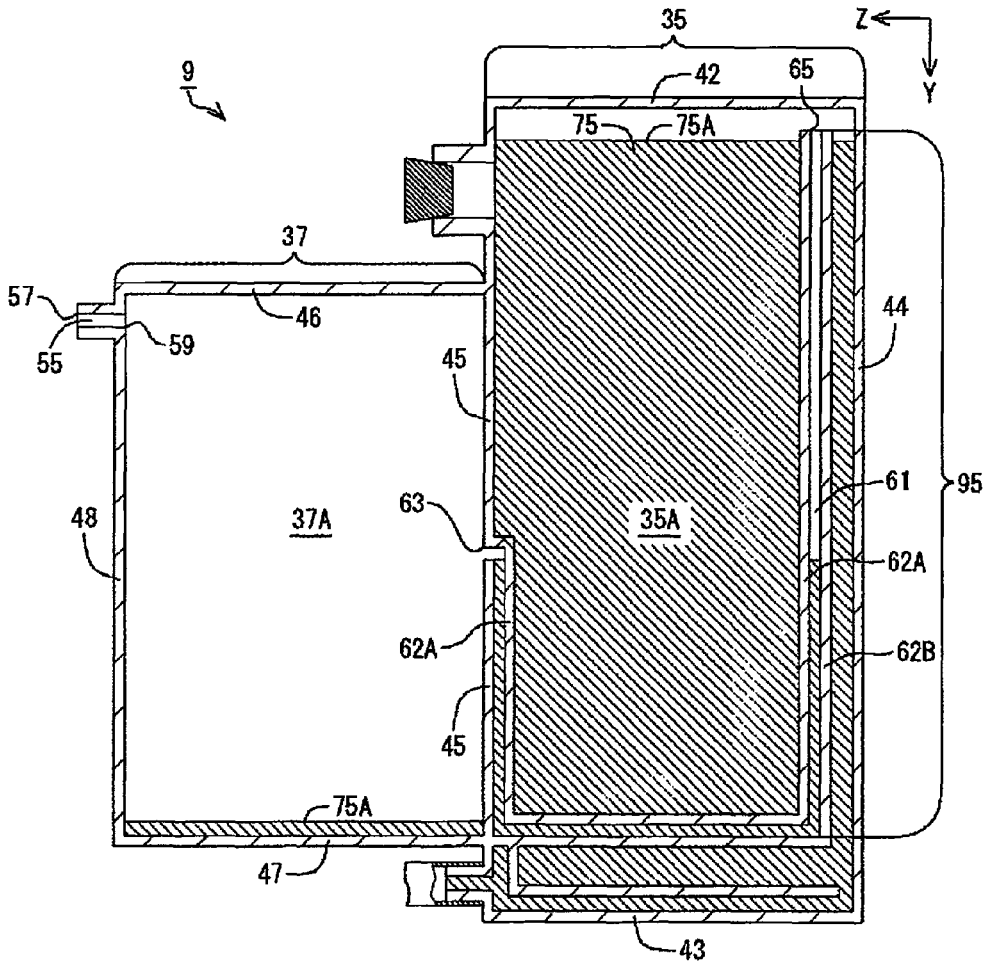
FIG. 14 is a sectional diagram illustrating a tank in the first attitude according to a third embodiment.

The following describes a tank 9 according to a third embodiment. The tank 9 of the third embodiment has a similar configuration to that of the tank 9 of the second embodiment, except that a delivery port 63 in the casing 31 is located vertically above the position of the delivery port 63 in the second embodiment in the first attitude as shown in FIG. 14. The like components to those of the second embodiment are thus expressed by the like signs to those of the second embodiment and are not specifically described.

In the third embodiment, a partition wall 62A is extended along the Z-axis direction from the fifth wall 45 toward the fourth wall 44, is bent with keeping a clearance from the fifth wall 45 and is extended along the fifth wall 45 toward the third wall 43. The partition wall 62A is then bent before reaching the partition wall 62B and is extended along the partition wall 62B with keeping a clearance from the partition wall 62B.

The third embodiment has similar advantageous effects to those of the second embodiment. Additionally, in the third embodiment, providing the delivery port 63 vertically above the position of the delivery port 63 in the second embodiment enables the ink in the second air introducing path 61 to remain in the second air introducing path 61 in the first attitude. This configuration reduces the amount of the ink 75 flowing into the recess 37A, compared with the second embodiment. The delivery port 63 is accordingly located vertically above the liquid level 75A of the ink 75 in the recess 37A. As a result, the configuration of the third embodiment more effectively suppresses the ink 75 from being leaked through the first air introducing path 55 out of the tank 9.

[Fourth Embodiment]

Figure 15:
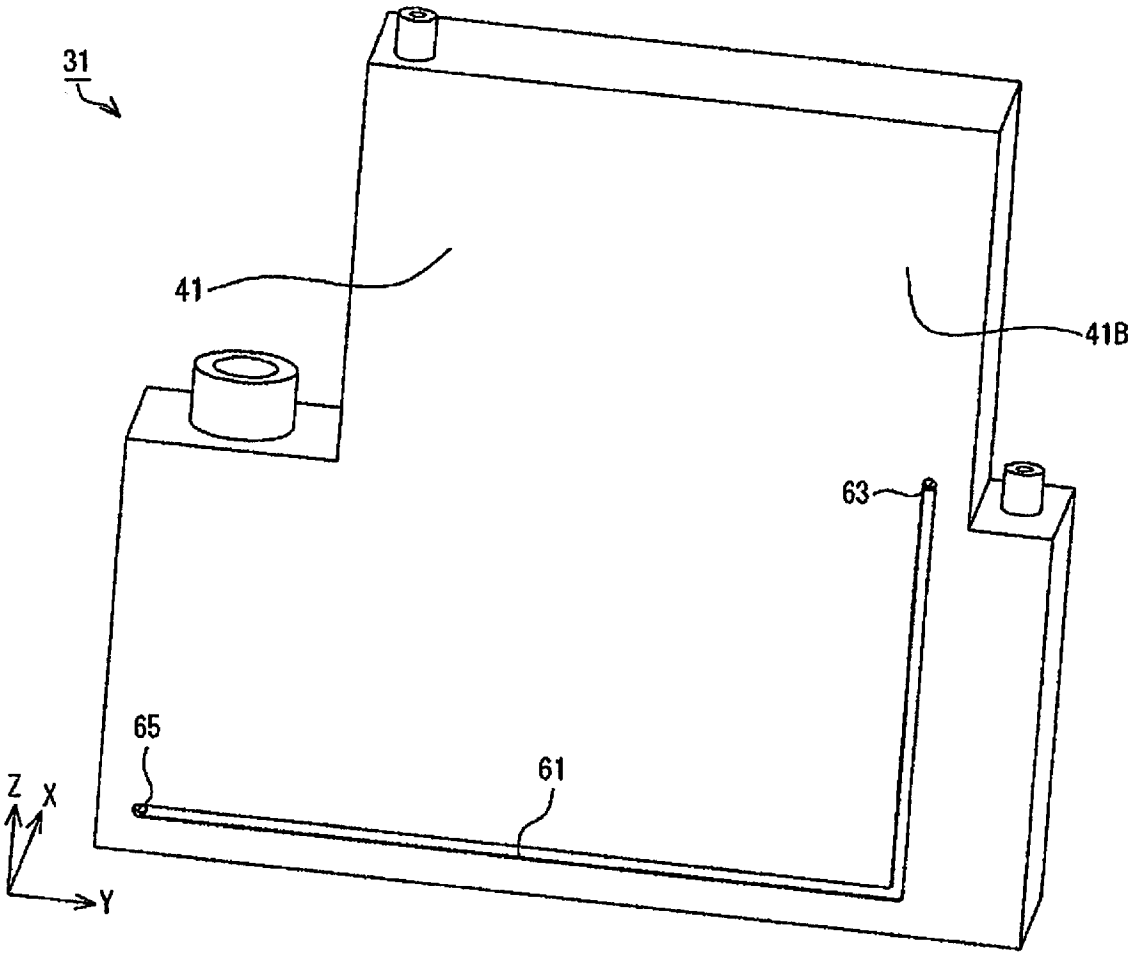
FIG. 15 is a perspective view illustrating a casing of a tank according to a fourth embodiment.

The following describes a tank 9 according to a fourth embodiment. The tank 9 of the fourth embodiment has a similar configuration to that of the tank 9 of the first embodiment, except that a second air introducing path 61 is provided outside of the casing 31 as shown in FIG. 15. The like components to those of the first embodiment are thus expressed by the like signs to those of the first embodiment and are not specifically described.

Figure 16:
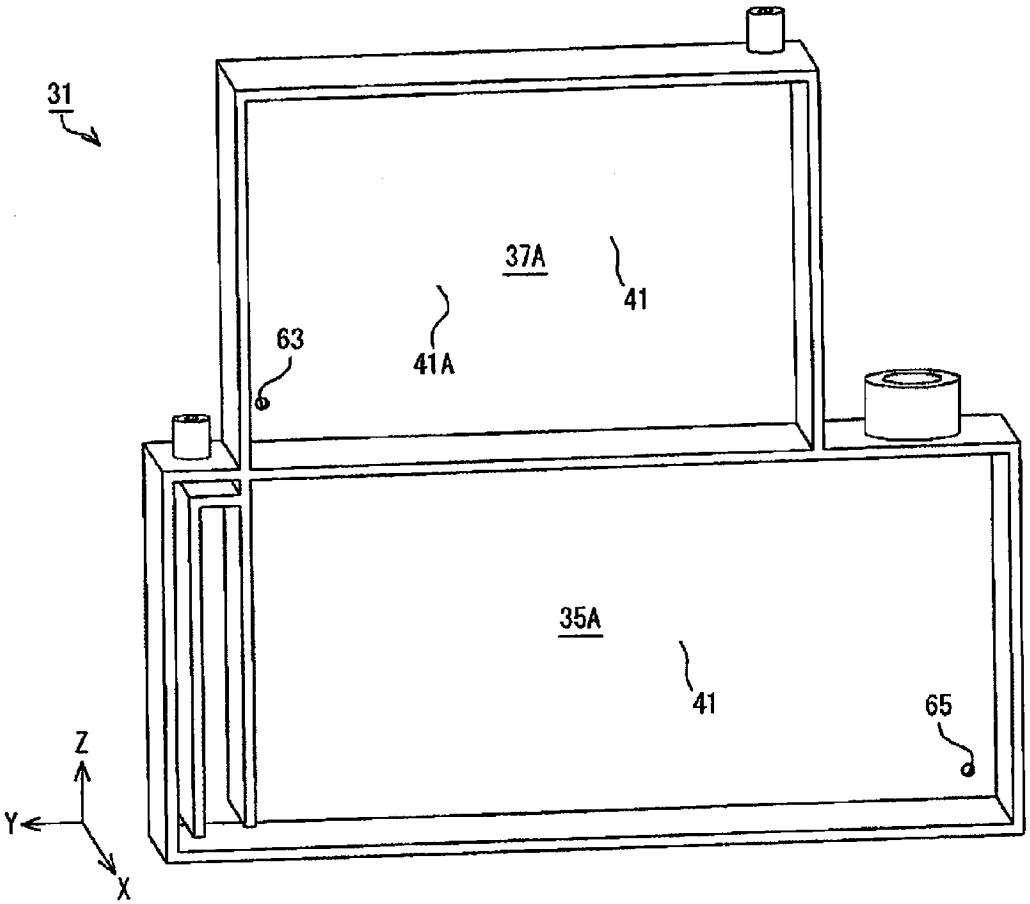
FIG. 16 is a perspective view illustrating the casing of the tank of the fourth embodiment.

In the fourth embodiment, a delivery port 63 is formed in the first wall 41 in the recess 37A as shown in FIG. 16. The delivery port 63 is provided as a through hole that is penetrated through the first wall 41 between inside of the recess 37A and outside of the recess 37A. A second introducing port 65 is formed in the first wall 41 in the recess 35A. The second introducing port 65 is provided as a through hole that is penetrated through the first wall 41 between inside of the recess 35A and outside of the recess 35A.

The second air introducing path 61 is provided on a surface 41B (outside of the casing 31) that is opposite to a surface 41A of the first wall 41 on the recess 37A-side (as shown in FIG. 15). The second air introducing path 61 is provided as a groove from a delivery port 63 to a second introducing port 65 on the surface 41B as shown in FIG. 15. Accordingly, the partition wall 62A and the partition wall 62B of the first embodiment are omitted in the fourth embodiment. The groove of the second air introducing path 61 is formed to be recessed in a direction from the surface 41B toward the surface 41A. The groove of the second air introducing path 61 including the delivery port 63 and the second introducing port 65 is sealed from the surface 41-side by a second sheet member (not shown). The fourth embodiment has similar advantageous effects to those of the first embodiment, the second embodiment and the third embodiment. Additionally, in the fourth embodiment, the capacity of the recess 35A is increased by omission of the partition wall 62A and the partition wall 62B.

In the first to the fourth embodiments described above, in the use state of the printer 3 for printing, the supply port 53 is located at a position higher than the liquid level of ink in the container portion 35. This configuration effectively suppresses leakage of ink out of the tank 9 even when the supply tube 16 is disconnected from the supply port 53. This accordingly suppresses the printer 3 from being stained with ink when the supply tube 16 is disconnected from the supply port 53. The first to the fourth embodiments employ the configuration that the supply port 53 faces the +Z-direction side. This configuration enables the supply tube 16 to be readily attached to and detached from the supply port 53 in the state that the tank 9 is mounted to the printer 3. This facilitates assembly of the printer 3.

[Fifth Embodiment]

Figure 17:
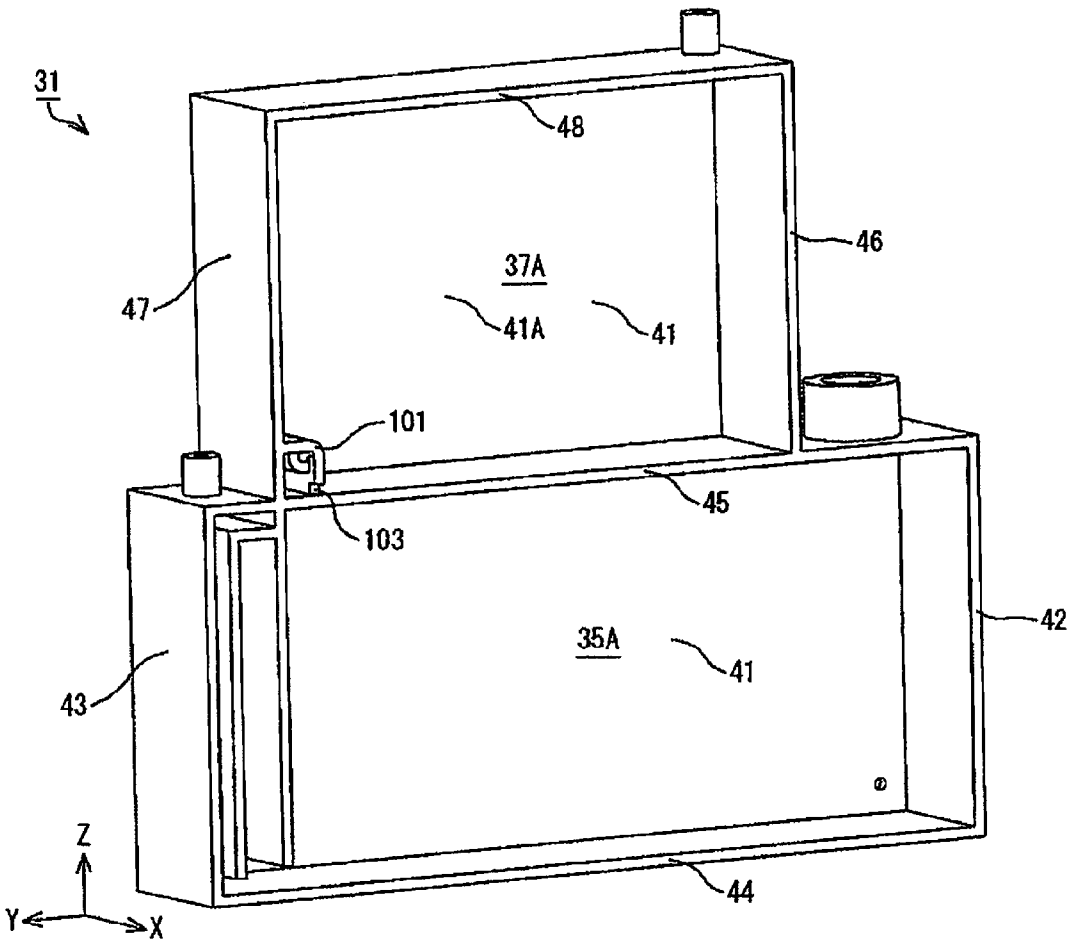
FIG. 17 is a perspective view illustrating a casing of a tank according to a fifth embodiment.

The following describes a tank 9 according to a fifth embodiment. The tank 9 of the fifth embodiment has a similar configuration to that of the tank 9 of the fourth embodiment, except that a bank 101 is provided on the first wall 41 to surround a delivery port 63 in the recess 37A as shown in FIG. 17. The like components to those of the fourth embodiment are thus expressed by the like signs to those of the fourth embodiment and are not specifically described.

In the fifth embodiment, the bank 101 is provided on the surface 41A of the first wall 41. The bank 101 is protruded from the surface 41A on the +X-axis direction side (opposite side to the surface 41B-side). In this embodiment, part of the fifth wall 45 and part of the seventh wall 47 constitute part of the bank 101. The amount of protrusion of the bank 101 from the first wall 41 except some part is set to be equal to the protrusion amount of the second wall 42 to the eighth wall 48. The bank 101 has a cut 103 provided at an end on an opposite side to the first wall 41-side. Accordingly, when the sheet member 33 is joined with the casing 31, inside of the recess 37A communicates with inside of the bank 101 via the cut 103. The air in the recess 37A is thus flowed through the cut 103 into the bank 101.

In the fifth embodiment, even when the ink 75 flows into the second air introducing path 61, the bank 101 is likely to block the ink 75 from flowing through the second air introducing path 61 into the recess 37A (air chamber 37). The ink 75 flowing into the second air introducing path 61 is thus unlikely to be flowed into the air chamber 37. As a result, this configuration more effectively suppresses the ink 75 from being leaked through the first air introducing path 55 out of the tank 9.

Figure 18:
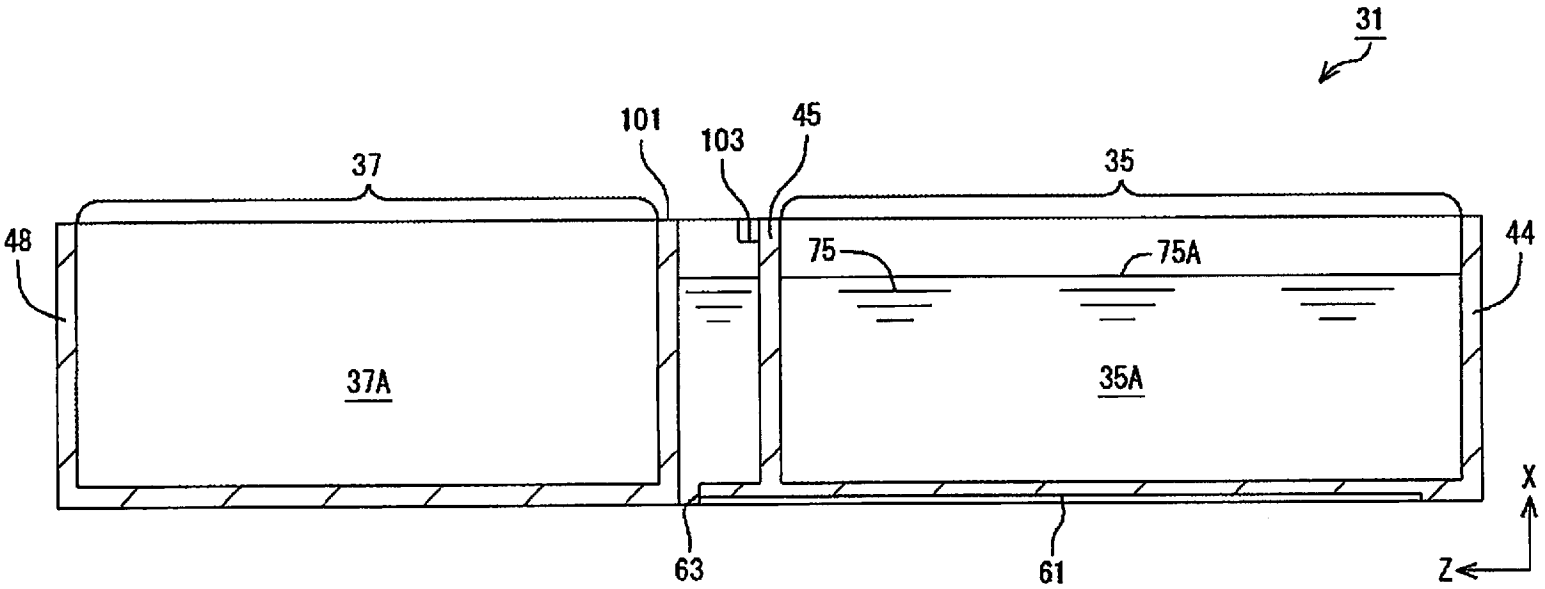
FIG. 18 is a sectional view illustrating the tank in a second attitude of the fifth embodiment.

In the attitude of the printer 3, the tank 9 may be inclined such that the −X-axis direction faces vertically downward as shown in FIG. 18. This attitude corresponds to a second attitude that the container portion 35 and the air chamber 37 are aligned in a direction intersecting with the vertical direction and that the sheet member 33 is located vertically below the first wall 41. An employable configuration in this state may be that the cut 103 of the bank 101 is located to be protruded in the vertical direction above the liquid level 75A of the ink 75 in the container portion 35. This configuration suppresses the ink 75 flowing into the second air introducing part 61 from overflowing from the bank 101. As a result, this more effectively suppresses the ink flowing into the second air introducing path 61 from flowing into the air chamber 37.

The fifth embodiment employs the configuration that the bank 101 is provided at the delivery port 63. Another employable configuration may be that the bank 101 is provided at the second introducing port 65. The configuration that the bank 101 is provided at the second introducing port 65 is likely to suppress the ink 75 in the container portion 35 from flowing into the second air introducing path 61 in a third attitude that the container portion 35 and the air chamber 37 are aligned in a direction intersecting with the vertical direction and that the sheet member 33 is located vertically below the first wall 41. This is attributed to that the bank 101 located to be protruded in the vertical direction above the liquid level 75A of the ink 75 stops the inflow into the second air introducing path 61 when the ink 75 in the container portion 35 flows into the second air introducing path 61. This suppresses the ink 75 from flowing from the container portion 35 into the air chamber 37. In this embodiment, the second introducing port 65 is provided on the first wall 41, like the delivery port 63. The third attitude is accordingly the same as the second attitude.

The configuration that the cut 103 of the bank 101 is located to be protruded in the vertical direction above the liquid level 75A of the ink 75 in the container portion 35 may also be employed for the bank 101 provided at the second introducing port 65. This configuration more effectively suppresses the ink 75 in the container portion 35 from flowing into the second air introducing path 61.

Additionally, another employable configuration may be that the bank 101 is provided at both the delivery port 63 and the second introducing port 65. This configuration more effectively suppresses the ink 75 in the container portion 35 from flowing into the air chamber 37 and thus more effectively suppresses the ink 75 from being leaked through the first air introducing path 55 out of the tank 9.

[Sixth Embodiment]

Figure 19:
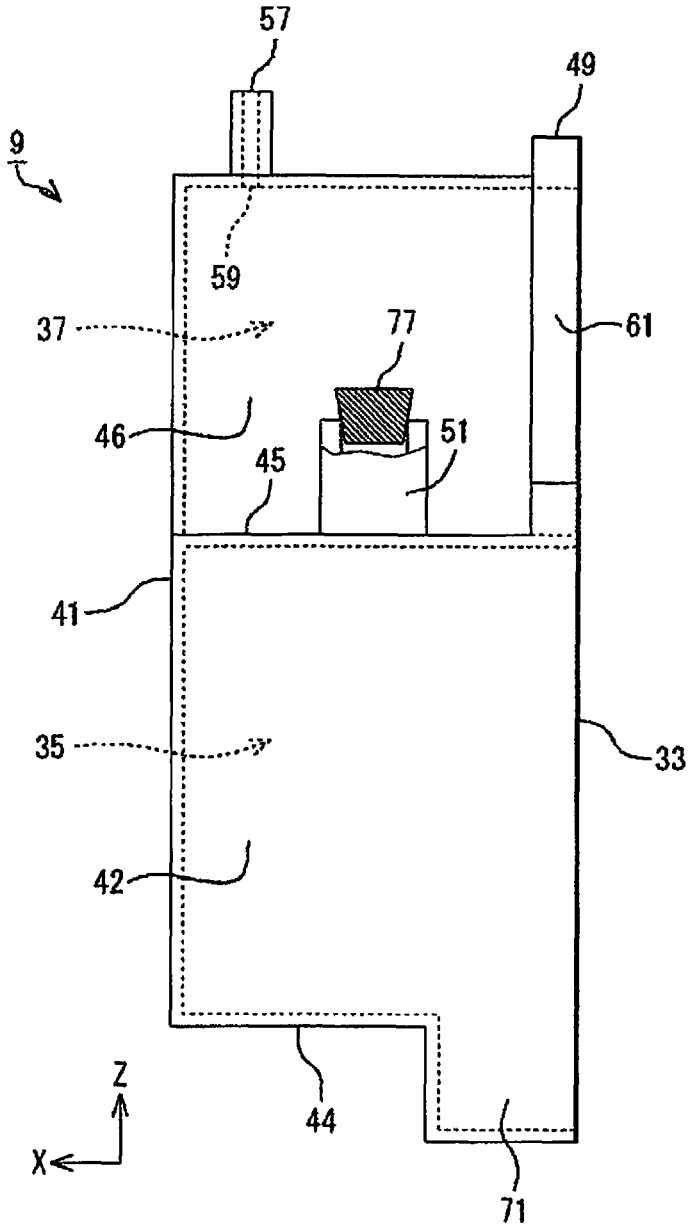
FIG. 19 is a diagram illustrating a casing of a tank according to a sixth embodiment, viewed from a second wall parallel to an XZ plane.
Figure 20:
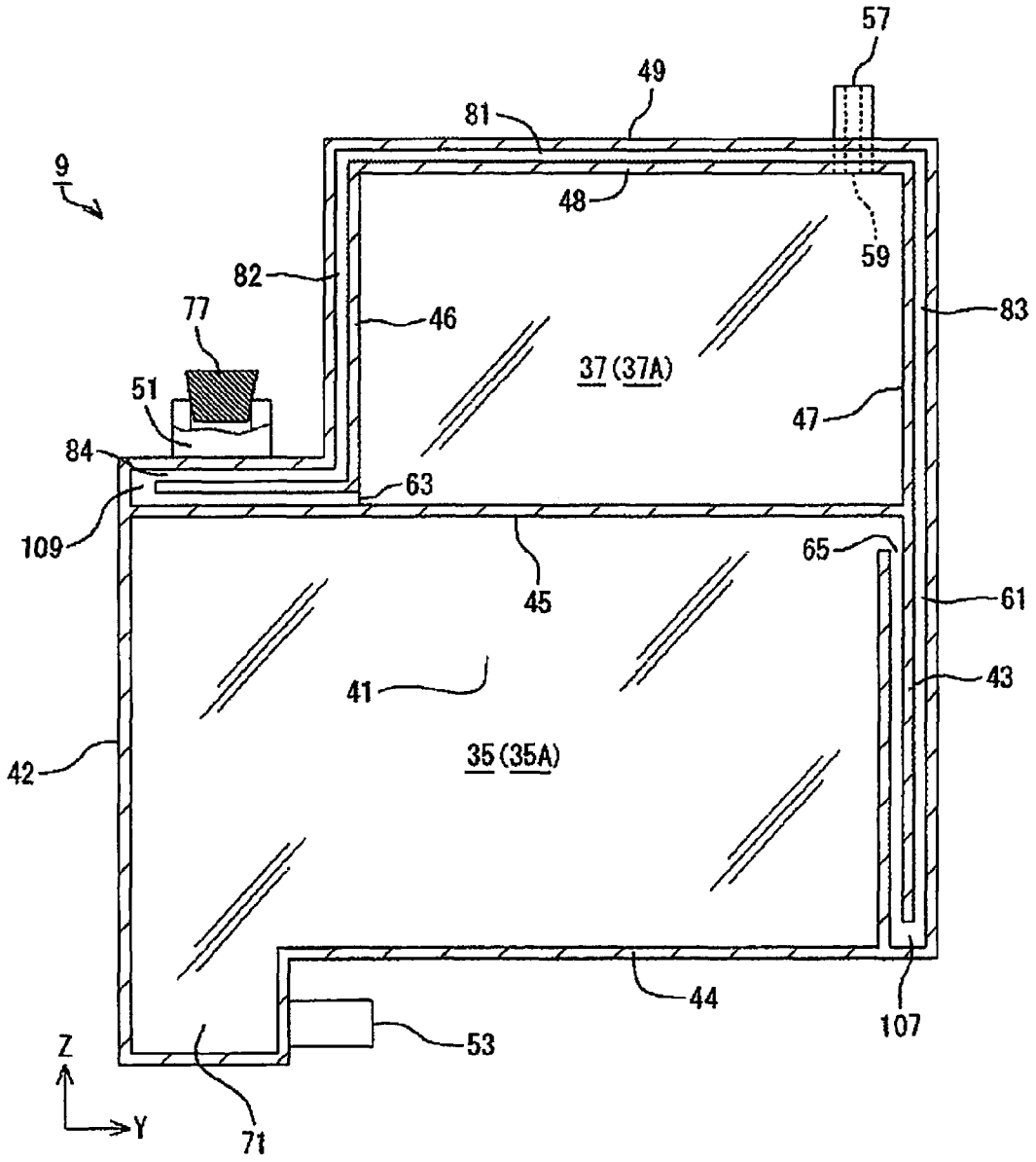
FIG. 20 is a diagram illustrating the casing of the tank of the sixth embodiment, viewed from a sheet member parallel to a YZ plane.

The following describes a tank 9 according to a sixth embodiment. FIG. 19 is a diagram illustrating the tank 9 of the sixth embodiment, viewed from the second wall 42 parallel to an XZ plane. FIG. 20 is a diagram illustrating the tank 9 of the sixth embodiment, viewed from the sheet member 33 parallel to the YZ plane. Components of FIGS. 19 and 20 expressed by the like signs to those of the above embodiments have the like functions and are not specifically described.

As shown in FIGS. 19 and 20, a first air introducing path 55 communicates with the air chamber 37 via the eighth wall 48. A first introducing port 59 is formed to be located vertically above a delivery port 63 and a second introducing port 65 when the tank 9 is placed in a second attitude that the sheet member 33 is located vertically below the first wall 41. The first introducing port 59 is also formed to be vertically above a liquid level in the tank 9 in the second attitude. This configuration suppresses leakage of ink from an air communication port 57 in the second attitude. In the sixth embodiment, an attitude that a surface of the sheet member 33 on an opposite side to a first wall 41-side faces vertically downward is a first attitude. In the sixth embodiment, the first introducing port 59 is provided vertically above the liquid level of ink in the recess 37A in the first attitude, like the first embodiment. This accordingly suppresses leakage of ink from the air communication port 57 even in the first attitude.

As shown in FIGS. 19 and 20, an inlet port 51 is formed to communicate with the container portion 35 via the fifth wall 45. At least part of the second air introducing path 61 is provided between an overhang 49 formed along the outer periphery of the air chamber 37 and the sheet member 33. The second air introducing path 61 of the embodiment includes at least a first flow path 81, a second flow path 82 connecting with the first flow path 81, a third flow path 83 connecting with the first flow path 81, and a fourth flow path 84 connecting with the second flow path 82. The first flow path 81 is formed to be extended vertically upward from the eighth wall 48 as shown in FIG. 20. The fourth flow path 84 is formed to be extended vertically upward from the fifth wall 45 as shown in FIG. 20. The second flow path 82 is formed to be extended from the sixth wall 46 in a direction intersecting with the vertical direction as shown in FIG. 20. The third flow path 83 is formed to be extended from the seventh wall 47 in a direction intersecting with the vertical direction as shown in FIG. 20. This configuration causes the first flow path 81 to be located vertically above the air chamber 37 in an attitude that the container portion 35 is located vertically below the air chamber 37. This reduces the likelihood that the ink in the container portion 35 enters the air chamber 37.

The third flow path 83 is located on the opposite side of the second flow path 82 across the air chamber 37. Accordingly, either the third flow path 83 or the second flow path 82 is located vertically above the air chamber 37 in an attitude that the container portion 35 and the air chamber 37 are aligned in a direction intersecting with the vertical direction. This reduces the likelihood that the ink in the container portion 35 enters the air chamber 37.

Additionally, with regard to a direction from the first wall 41 toward the sheet member 33, the overhang 49 is formed to have a thickness in the direction from the first wall 41 toward the sheet member 33 less than the distance between the first wall 41 and the sheet member 33. This reduces the likelihood that the ink moves through the second air introducing path 61.

The third flow path 83 is provided with an inversion section 107 where the direction of the flow path is reversed. The third flow path 83 extended from the first flow path 81 toward the fourth wall 44 is reversed at the inversion section 107 to the direction from the fourth wall 44 toward the eight wall 48. In another respect, the third flow path 83 is reversed at the inversion section 107 from the vertically downward direction to the vertically upward direction. According to this embodiment, the third flow path 83 is in a U shape. In the air path from the air communication port 57 to the container portion 35, the air communication port 57-side is upstream side and the second introducing port 65-side is downstream side.

In the state that ink flows from the second introducing port 65 to enter the third flow path 83, when the attitude of the tank 9 is not changed, the ink entering the third flow path 83 is unlikely to flow back to the upstream of the third flow path 83 across the inversion section 107. More specifically, the ink flows back to the upstream of the inversion section 107 only upon satisfaction of both the conditions that a significant impact is applied to break the ink meniscus at the second introducing port 65 and that the attitude of the printer 3 is subsequently changed significantly. It is very rare that both the conditions are satisfied. It is thus extremely unlikely that the ink in the container portion 35 flows back through the third flow path 83 to reach the first flow path 81. This accordingly reduces the likelihood that the ink in the container portion 35 enters the air chamber 37.

Additionally, according to this embodiment, the fourth flow path 84 is also provided with an inversion section 109. The fourth flow path 84 extended from the second flow path 82 toward the second wall 42 is reversed at the inversion section 109 to the direction from the second wall 42 toward the air chamber 37. In another respect, in the attitude that the third wall 43 and the seventh wall 47 are located vertically above the second wall 42, the fourth flow path 84 is reversed at the inversion section 109 from the vertically downward direction to the vertically upward direction. According to this embodiment, the fourth flow path 84 is in a U shape.

In the state that ink flows from the second flow path 82 to enter the fourth flow path 84, when the attitude of the tank 9 is not changed, the ink entering the fourth flow path 84 is unlikely to flow back to the upstream of the fourth flow path 84 across the inversion section 109. More specifically, the ink flows back to the upstream of the inversion section 109 only upon satisfaction of both the conditions that ink flows back to the upstream of the inversion section 107 and that the attitude of the printer 3 is subsequently changed significantly. It is very rare that both the conditions are satisfied. It is thus extremely unlikely that the ink in the container portion 35 flows back through the fourth flow path 84 to reach the air chamber 37. This accordingly reduces the likelihood that the ink in the container portion 35 enters the air chamber 37.

According to this embodiment, the second introducing port 65 is provided at a position nearer to the fifth wall 45 than the fourth wall 44. This configuration facilitates locating the second introducing port 65 at a position higher than the liquid level of ink in the container portion 35 in this embodiment. According to this embodiment, the upper limit of the amount of ink in the container portion 35 is determined to keep the liquid level of ink in the container portion 35 lower than the second introducing port 65. The second introducing port 65 is thus located to be protruded in the vertical direction above the liquid level of ink in the container portion 35. When the air in the air chamber 37 is introduced into the container portion 35 in the course of printing with the ejection head 19, this configuration effectively suppresses the air introduced into the container portion 35 from passing through the ink in the form of bubbles.

A gas in the form of bubbles that pass through ink is more likely to be dissolved in the ink, compared with the case that the ink surface is statistically exposed to the gas. The gas dissolved in the ink may come out as bubbles in the ink supply path or inside the ejection head 19. The presence of such bubbles in the ink in the ejection head 19 may deteriorate the ink ejection performance. The gas dissolved in the ink may cause deterioration of the ink ejection performance of the ejection head 19. Deterioration of the ink ejection performance may be, for example, the amount of ink droplets out of a specified range, failure in ejection of ink droplets or deviation of the direction of ink droplets ejected.

In the configuration of this embodiment, however, the second introducing port 65 is located to be protruded in the vertical direction above the liquid level of ink in the container portion 35. This effectively suppresses the air introduced into the container portion 35 from passing through the ink in the form of bubbles. This accordingly reduces dissolution of the air in the ink in the container portion 35 and suppresses the air from being mixed into the ink in the ejection head 19. As a result, the configuration of this embodiment suppresses deterioration of the ink ejection performance of the ejection head 19.

[Seventh Embodiment]

The following describes a tank 9 according to a seventh embodiment. The tank 9 of the seventh embodiment has a similar configuration to that of the tank 9 of the sixth embodiment, except the configuration of an air chamber 37. The like components to those of the sixth embodiment are thus expressed by the like signs to those of the sixth embodiment and are not specifically described.

Figure 21:
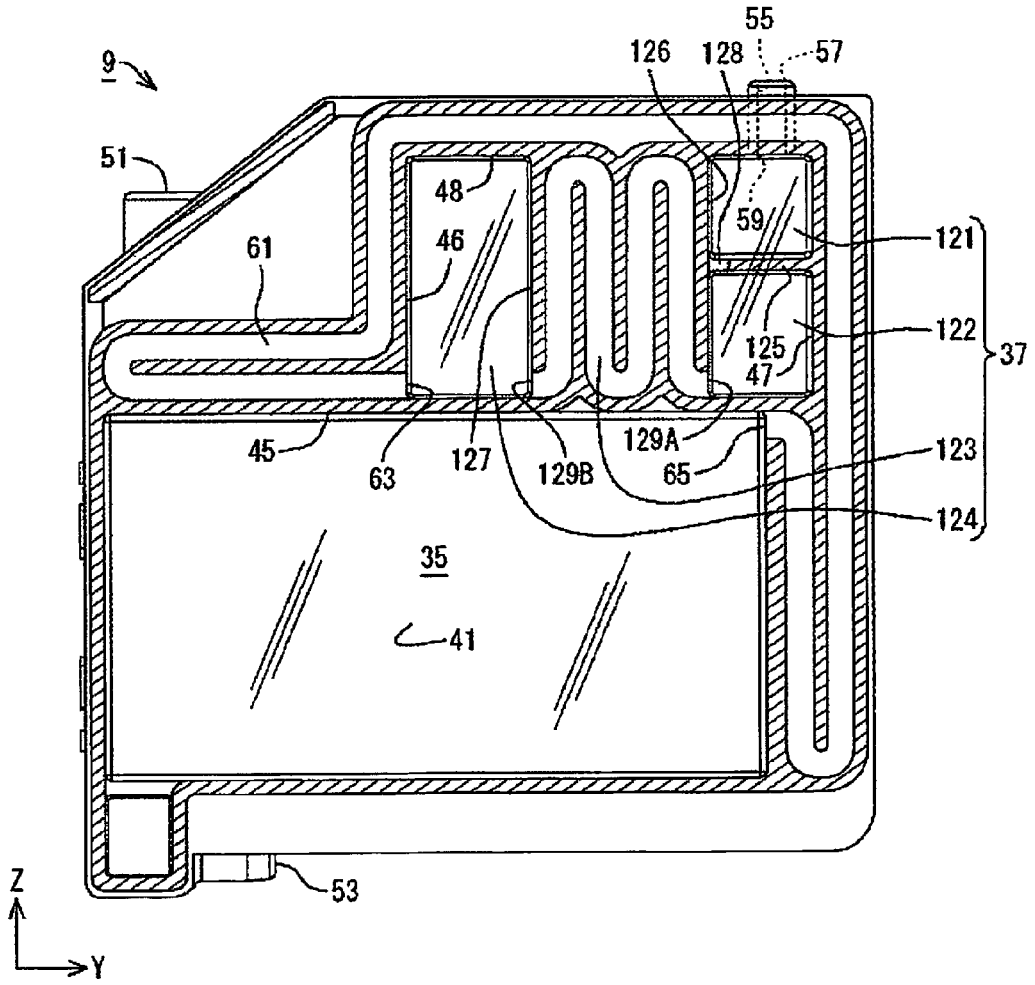
FIG. 21 is a diagram illustrating a tank according to a seventh embodiment, viewed from a sheet member parallel to a YZ plane.

In the tank 9 of the seventh embodiment, as shown in FIG. 21, the air chamber 37 has a first air chamber 121, a second air chamber 122, a communication path 123 and a third air chamber 124. The first air chamber 121 is provided at a position overlapping the first air introducing path 55 and communicates with outside of the tank 9 via the first air introducing path 55. The second air chamber 122 is provided at a position overlapping the first air chamber 121 across a ninth wall 125 provided in the casing 31. The third air chamber 124 is provided on a sixth wall 46-side relative to the first air chamber 121 and the second air chamber 122. The third air chamber 124 communicates with the second air introducing path 61 via a delivery port 63.

A tenth wall 126 and an eleventh wall 127 are provided between the second air chamber 122 and the third air chamber 124. The first air chamber 121 and the second air chamber 122 are separated from the third air chamber 124 in the Y-axis direction by the tenth wall 126 and the eleventh wall 127. The tenth wall 126 is provided nearer to the sixth wall 46 than the seventh wall 47 and is arranged to face the seventh wall 47. The eleventh wall 127 is provided nearer to the seventh wall 47 than the sixth wall 46 and is arranged to face the sixth wall 46. The eleventh wall 127 is also provided nearer to the sixth wall 46 than the tenth wall 126.

The first air chamber 121 is formed by the first wall 41, the seventh wall 47, the eighth wall 48, the ninth wall 125, the tenth wall 126 and the sheet member 33. The second air chamber 122 is formed by the first wall 41, the fifth wall 45, the seventh wall 47, the ninth wall 125, the tenth wall 126 and the sheet member 33. A communication port 128 is provided in the ninth wall 125. The first air chamber 121 communicates with the second air chamber 122 via the communication port 128. The third air chamber 124 is formed by the first wall 41, the fifth wall 45, the sixth wall 46, the eighth wall 48, the eleventh wall 127 and the sheet member 33.

The communication path 123 is provided between the tenth wall 126 and the eleventh wall 127 to make the second air chamber 122 and the third air chamber 124 communicate with each other. The communication path 123 is in a serpentine shape. The second air chamber 122 communicates with the communication path 123 via a communication port 129A. The third air chamber 124 communicates with the communication path 123 via a communication port 129B. This configuration causes the container portion 35 to communicate with the outside of the tank 9 via the second air introducing path 61, the third air chamber 124, the communication path 123, the second air chamber 122, the first air chamber 121 and the first air introducing path 55.

Figure 22:
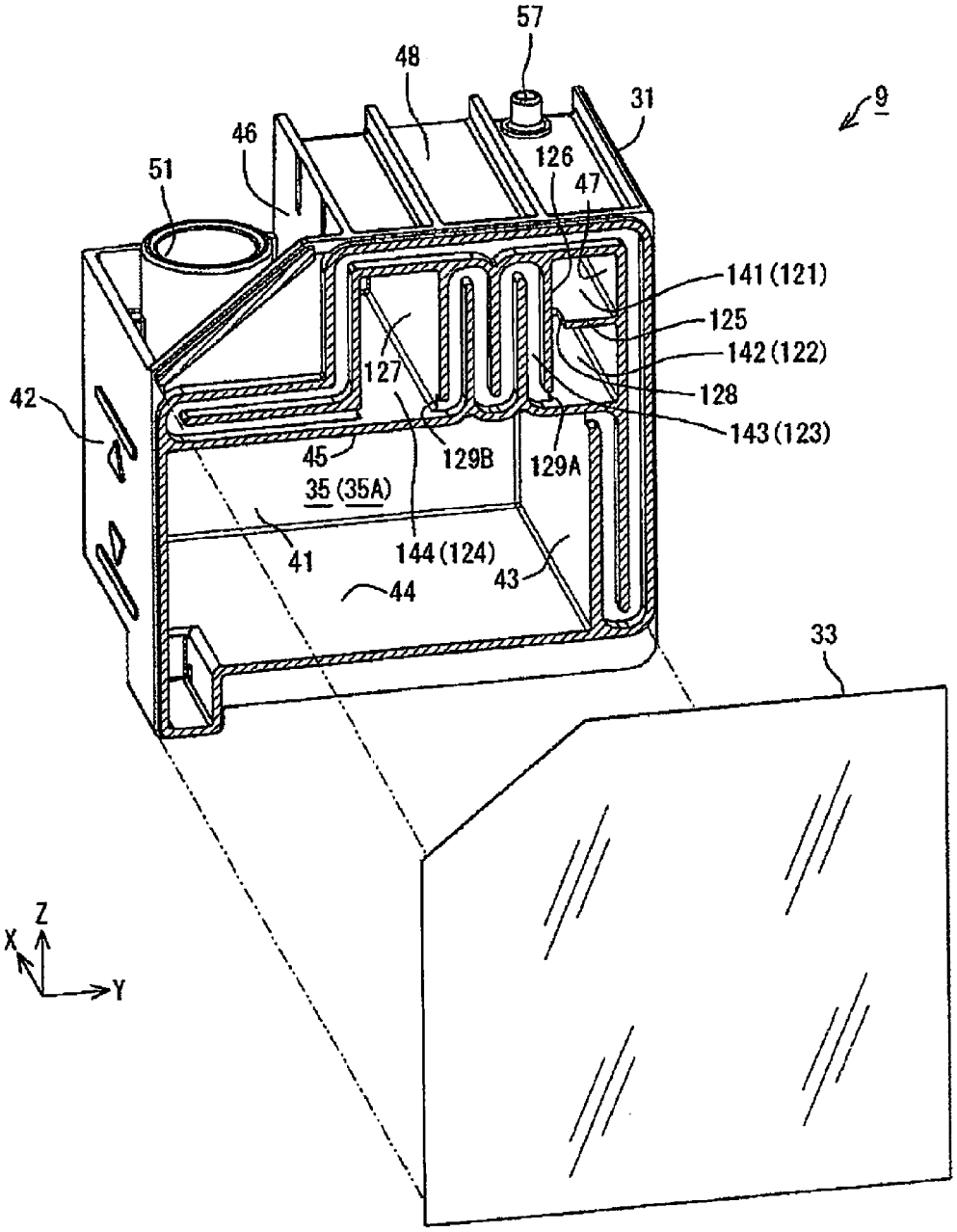
FIG. 22 is an exploded perspective view illustrating the tank of the seventh embodiment.

As shown in FIG. 22, the casing 31 has a recess 141, a recess 142, a groove 143 and a recess 144. The recess 141, the recess 142, the groove 143 and the recess 144 are respectively formed to be concave toward an opposite side to the sheet member 33-side, i.e., toward the first wall 41-side. The recess 141 is formed by surrounding the first wall 41 with the seventh wall 47, the eighth wall 48, the ninth wall 125 and the tenth wall 126. The recess 142 is formed by surrounding the first wall 41 with the fifth wall 45, the seventh wall 47, the ninth wall 125 and the tenth wall 126. The recess 144 is formed by surrounding the first wall 41 with the fifth wall 45, the sixth wall 46, the eighth wall 48 and the eleventh wall 127.

The groove 143 is provided in an area surrounded by the fifth wall 45, the tenth wall 126, the eighth wall 48 and the eleventh wall 127. The depth of the groove 143 in the X-axis direction is less than the depths of the recesses 142 and the 144 in the X-axis direction. The communication port 128 is formed as a cut provided in the ninth wall 125. The recess 141 and the recess 142 communication with each other via the communication port 128 formed as the cut. The communication port 128A is formed as a cut provided in the tenth wall 126. Similarly the communication port 128B is formed as a cut provided in the eleventh wall 127.

The first air chamber 121 has the recess 141 provided in the casing 31 and sealed by the sheet member 33. The second air chamber 122 has the recess 142 provided in the casing 31 and sealed by the sheet member 33. The third air chamber 124 has the recess 144 provided in the casing 31 and sealed by the sheet member 33. The communication path 123 has the groove 143 provided in the casing 31 and sealed by the sheet member 33. The seventh embodiment of this configuration achieves the similar advantageous effects to those of the sixth embodiment.

Additionally, in the seventh embodiment, the communication path 123 is provided on the first air introducing path 55-side of the third air chamber 124. As described previously, the communication path 123 is in a serpentine shape. The moving ink that has entered the communication path 123 is trapped in the middle of the communication path 123. This further suppresses the ink from reaching the first introducing port 59.

Moreover, in the seventh embodiment, the second air chamber 122 is provided on the first air introducing path 55-side of the third air chamber 124. This configuration further reduces the likelihood that the ink flowing from the delivery port 63 to enter the third air chamber 124 reaches the first introducing port 59. Furthermore, in the seventh embodiment, the first air chamber 121 is provided on the first air introducing path 55-side of the third air chamber 124. This configuration further reduces the likelihood that the ink flowing from the delivery port 63 to enter the third air chamber 124 reaches the first introducing port 59.

Like the first embodiment to the fourth embodiment, the configuration that the supply port 53 is located at a higher position than the liquid level of ink in the container portion 35 in the use state of the printer 3 for printing may be applied to the sixth embodiment or the seventh embodiment. This configuration effectively suppresses leakage of ink out of the tank 9 even when the supply tube 16 is disconnected from the supply port 53. This accordingly suppresses the printer 3 from being stained with ink when the supply tube 16 is disconnected from the supply port 53. Like the first embodiment to the fourth embodiment, the configuration that the supply port 53 faces the +Z-axis direction side may be applied to the sixth embodiment or the seventh embodiment. This configuration enables the supply tube 16 to be readily attached to and detached from the supply port 53 in the state that the tank 9 is mounted to the printer 3. This facilitates assembly of the printer 3.

In each of the first embodiment to the seventh embodiment described above, the tank 9 may be comprised of only two components, i.e., the casing 31 and the sheet member 33. This is likely to reduce the cost of the tank 9 and thereby reduce the cost of the printer 3.

In each of the embodiments described above, the liquid consuming device is not limited to the configuration that the tanks 9 are placed inside the casing 7 shown in FIGS. 1 and 2. For example, a container unit 8 may be externally mounted to a casing 7 as shown in FIGS. 23, 24 and 25.

Figure 23:
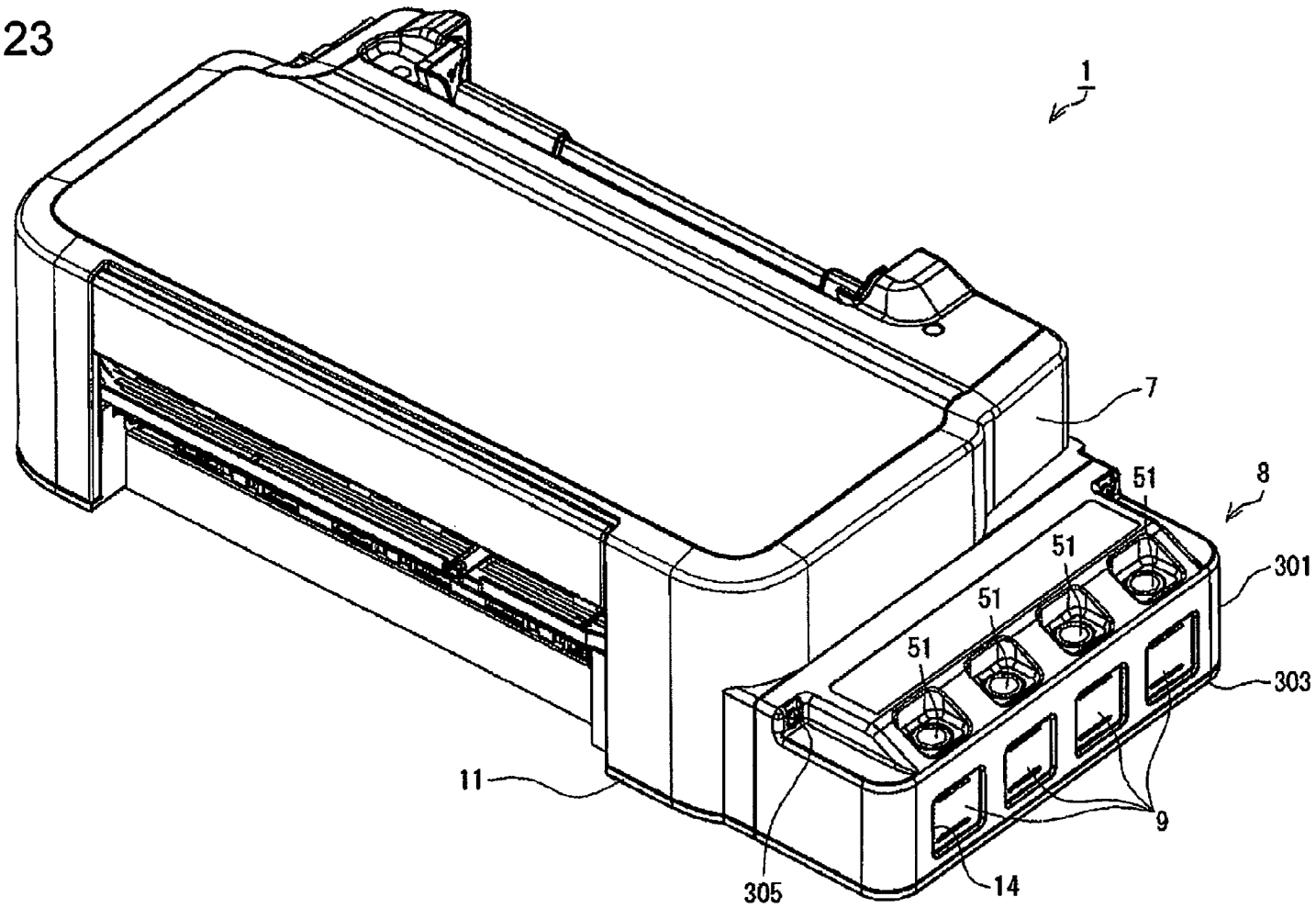
FIG. 23 is a perspective view illustrating one example of a liquid consuming device according to one embodiment.

FIG. 23 illustrates an exemplary state that the container unit 8 is mounted to the casing 7. The container unit 8 includes an upper cover member 301, a bottom cover member 303 and a plurality of tanks 9 placed on the bottom cover member 303. The upper cover member 301 is fixed to the casing 7 by means of a first fixation member 305. The first fixation member 305 may employ a screw structure, but this is not restrictive. The first fixation member 305 may employ any other suitable structure having a fixation function.

Each of the plurality of tanks 9 has one inlet port 51. A first air introducing path 55 is mounted to each inlet port 51. Each inlet port 51 is exposed to the outside through one of a plurality of openings provided in the upper cover member 301 to allow for filling with liquid. Each of the plurality of tanks 9 is placed corresponding to one of a plurality of windows 14 provided in the upper cover member 301 to be visible from outside.

Figure 24:
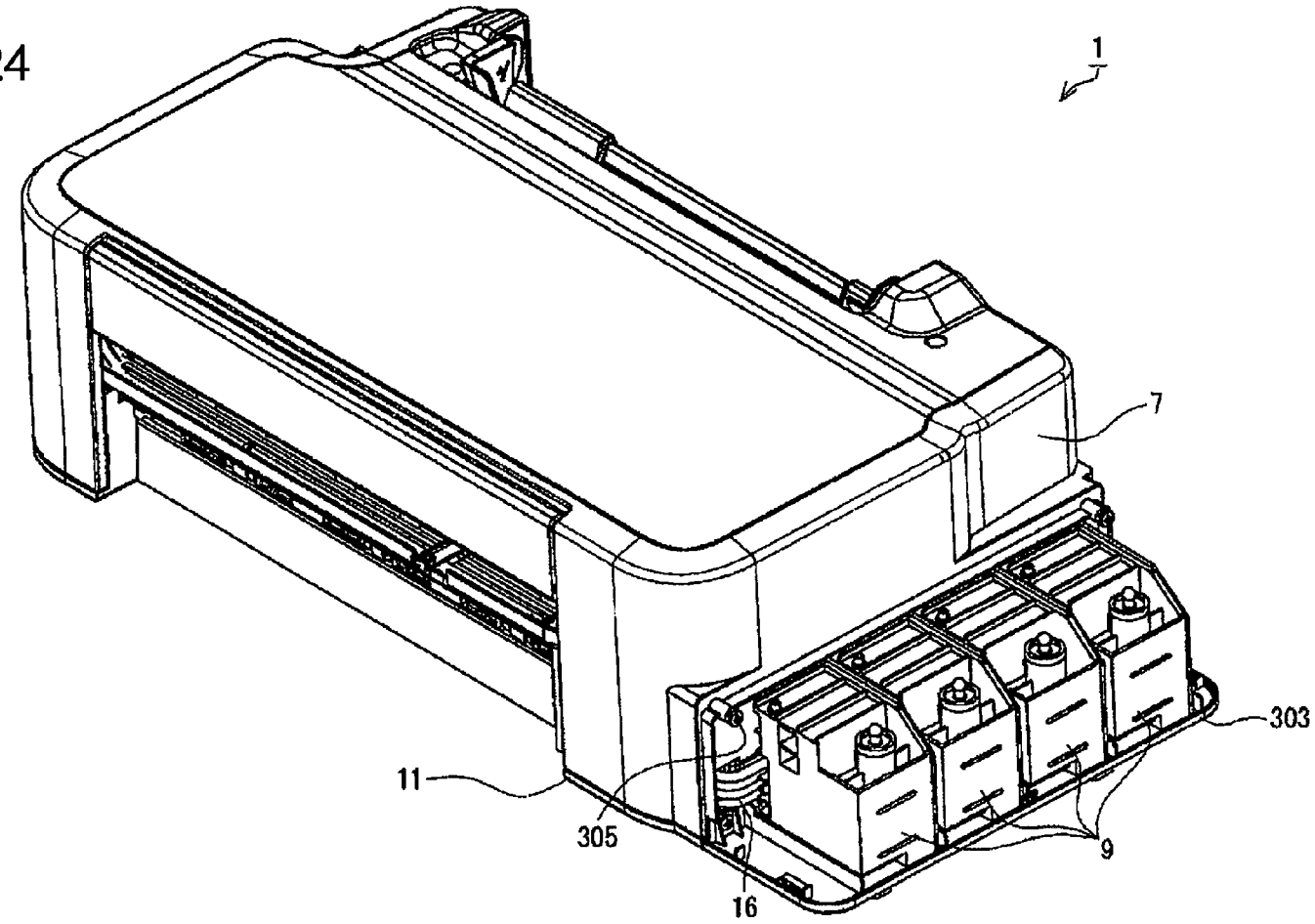
FIG. 24 is a perspective view illustrating the example of the liquid consuming device of the embodiment.
Figure 25:
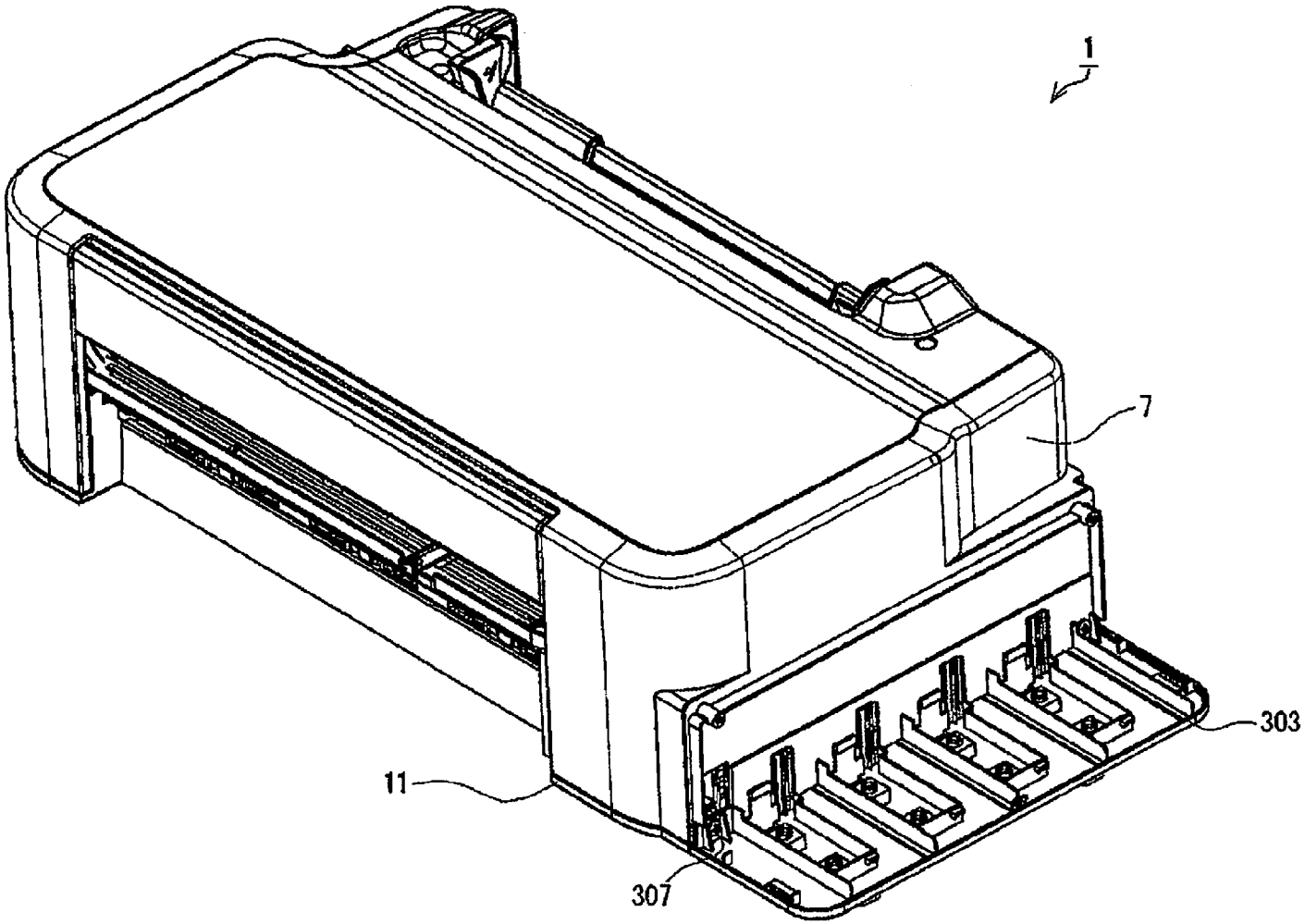
FIG. 25 is a perspective view illustrating the example of the liquid consuming device of the embodiment.

FIG. 24 illustrates an exemplary state that the upper cover member 301 is detached from the container unit 8. For convenience of explanation, the first air introducing path 55 is mounted to the inlet port 51 in FIG. 24. As clearly understood from this illustration, one supply tube 16 is attached to each of the plurality of tanks 9. Each supply tube 16 communicates with a built-in ejection head 19 through an opening provided on a side face of the casing 7.

FIG. 25 illustrates an example of the bottom cover member 303 of the container unit 8. The bottom cover member 303 is fixed to part of mechanics 11 that is covered by the casing 7, by means of a second fixation member 307. The second fixation member 307 may employ a screw structure, but this is not restrictive. The second fixation member 307 may employ any other suitable structure having a fixation function.

In the configuration shown in FIGS. 23, 24 and 25, the upper cover member 301 of the container unit 8 is fixed to the casing 7 by the first fixation member 305, and the bottom cover member 303 is fixed to the mechanics 11 by the second fixation member 307. This configuration improves the stability of fixation of the container unit 8 to the liquid consuming device. The stability may further be increased by fixing the bottom cover member 303 to both the casing 7 and the mechanics 11.

In the respective embodiments described above, the liquid consuming device may be a liquid consuming device that sprays, ejects or applies and thereby consumes a liquid other than ink. The liquid ejected in the form of very small amounts of droplets from the liquid consuming device may be in a granular shape, a teardrop shape or a tapered threadlike shape. The liquid herein may be any material consumed in the liquid consuming device. The liquid may be any material in the liquid phase and may include liquid-state materials of high viscosity or low viscosity, sols, aqueous gels and other liquid-state materials including inorganic solvents, organic solvents, solutions, liquid resins and liquid metals (metal melts). The liquid is not limited to the liquid state as one of the three states of matter but includes solutions, dispersions and mixtures of the functional solid material particles, such as pigment particles or metal particles, solved in, dispersed in or mixed with a solvent. Typical examples of the liquid include ink described in the above embodiments and liquid crystal. The ink herein includes general water-based inks and oil-based inks, as well as various liquid compositions, such as gel inks and hot-melt inks. A concrete example of the liquid consuming device may be a liquid ejection device that ejects a liquid in the form of a dispersion or a solution containing a material such as an electrode material or a color material used for production of liquid crystal displays, EL (electroluminescent) displays, surface emission displays and color filters. The liquid consuming device may also be a liquid ejection device that ejects a bioorganic material used for manufacturing biochips, a liquid ejection device that is used as a precision pipette and ejects a liquid as a sample, a printing device or a microdispenser. Additionally, the liquid consuming device may be a liquid ejection device for pinpoint ejection of lubricating oil on precision machines such as machines and cameras or a liquid ejection device that ejects a transparent resin solution of, for example, an ultraviolet curable resin, onto a substrate to manufacture a hemispherical microlens (optical lens) used for optical communication elements and the like. As another example, the liquid consuming device may be a liquid ejection device that ejects an acidic or alkaline etching solution to etch a substrate or the like.

REFERENCE SIGNS LIST

1 multifunction printer
3 printer
5 scanner unit
7 casing
8 container unit
9 tanks
11 mechanics
12 operation panel
13A power button
13B operation button
14 window
15 printing assembly
16 supply tube
17 carriage
19 ejection head
21 relay unit
23 motor
25 timing belt
31 casing
33 sheet member
35 container portion
35A recess
37 air chamber
37A recess
41 first wall (main wall)
41A surface
41B surface
42 second wall
43 third wall
44 fourth wall
45 fifth wall (partition wall)
46 sixth wall
47 seventh wall
48 eighth wall
49 overhang
51 inlet port
53 supply port
55 first air introducing path
57 air communication port
59 first introducing port
61 second air introducing part
62A, 62B partition walls
63 delivery port
65 second introducing port
66 air flow path
67 air buffer chamber
71 supply path
72A partition wall
75 ink
75A liquid level
77 plug
79 air
81 first flow path
82 second flow path
83 third flow path
84 fourth flow path
91 meniscus
95 portion
101 bank
103 cut
107 inversion section
109 inversion section
121 first air chamber
122 second air chamber
123 communication path
124 third air chamber
125 ninth wall
126 tenth wall
127 eleventh wall
128 communication port
129A, 129B communication ports
141 recess
142 recess
143 groove
144 recess
301 upper cover member
303 bottom cover member
305 first fixation member
307 second fixation member
P printing medium

The invention claimed is:

1. A liquid container, comprising:

a storage chamber configured to contain a liquid;

an air chamber provided to communicate with the storage chamber and configured to contain the air that is introduced into the storage chamber; and an air introducing path provided between the air chamber and the storage chamber and configured to introduce the air contained in the air chamber into the storage chamber, wherein a first introducing port formed to introduce the air into the air chamber is located vertically above a liquid level in the air chamber of the liquid that flows from the storage chamber into the air chamber, in a first attitude that the storage chamber and the air chamber are aligned in a direction intersecting with a vertical direction and that the first introducing port is located vertically above a delivery port which is an air chamber-side opening of the air introducing path, the air introducing path includes a portion extended vertically upward in the first attitude, a second introducing port which is a storage chamber-side opening of the air introducing path is provided in the portion extended vertically upward, the storage chamber is a space formed between a first sheet member and a main wall, the air chamber is a space formed between the first sheet member and the main wall and separated from the storage chamber by a partition wall, the delivery port is formed to pass through the main wall and to be open from inside of the air chamber toward outside of the air chamber, the second introducing port is formed to pass through the main wall and to be open from outside of the storage chamber toward inside of the storage chamber, and the air introducing path making the storage chamber communicate with the air chamber leads from the delivery port to the second introducing port through a surface of the main wall on an opposite side to the air chamber and a surface of the main wall on an opposite side to the storage chamber.

2. The liquid container according to claim 1, wherein the delivery port is located vertically above the liquid level in the air chamber in the first attitude.

3. The liquid container according to claim 1, wherein the air introducing path is a groove that is provided on the surface of the main wall on the opposite side to the air chamber and the surface of the main wall on the opposite side to the storage chamber and that is sealed by a second sheet member.

4. The liquid container according to claim 1, wherein a first bank is provided inside of the air chamber to surround the delivery port.

5. The liquid container according to claim 4, wherein the first bank is located to be protruded from a liquid level of the liquid in the storage chamber in a second attitude that the storage chamber and the air chamber are aligned in a direction intersecting with the vertical direction and that the first sheet member is located vertically below the main wall.

6. The liquid container according to claim 1, wherein a second bank is provided inside of the storage chamber to surround the second introducing port.

7. The liquid container according to claim 6, wherein the second bank is located to be protruded from a liquid level of the liquid in the storage chamber in a third attitude that the storage chamber and the air chamber are aligned in a direction intersecting with the vertical direction and that the first sheet member is located vertically below the main wall.

8. The liquid container according to claim 1, wherein the storage chamber is a space formed between a first sheet member and a main wall, the air chamber is a space formed between the first sheet member and the main wall and separated from the storage chamber by a partition wall, the air introducing path includes a first flow path formed along an outer periphery of the air chamber, and the first flow path is formed to be located vertically above the air chamber in an attitude that the storage chamber is located vertically below the air chamber.

9. The liquid container according to claim 8, wherein the air introducing path connects with the first flow path and includes a third flow path formed along the outer periphery of the air chamber, and the third flow path is located on an opposite side to the second flow path across the air chamber.

10. The liquid container according to claim 8, further comprising a supply tube connecting with the supply port.

11. A liquid container, comprising:

a storage chamber configured to contain a liquid;

an inlet port provided to communicate with the storage chamber and configured to fill the storage chamber with the liquid;

a supply port provided to communicate with the storage chamber and configured to supply the liquid to outside;

an air chamber provided to communicate with the storage chamber and configured to contain an air that is introduced into the storage chamber; and an air introducing path provided between the air chamber and the storage chamber and configured to introduce the air contained in the air chamber into the storage chamber, wherein the air introducing path includes a first flow path formed along an outer periphery of the air chamber, the first flow path is formed to be located vertically above the air chamber in an attitude that the storage chamber is located vertically below the air chamber, the air introducing path connects with the first flow path and includes a second flow path formed along the outer periphery of the air chamber, and the second flow path is located vertically above the air chamber in an attitude that the storage chamber and the air chamber are aligned in a direction intersecting with a vertical direction.

12. The liquid container according to claim 11, wherein the air chamber is a space formed between a first sheet member and a main wall, and the first flow path is provided by the first sheet member and an overhang formed along the outer periphery of the air chamber.

13. The liquid container according to claim 12, wherein the overhang has a thickness in a direction from the main wall toward the first sheet member less than a distance between the main wall and the first sheet member.

* * * * *